US005839679A

United States Patent [19]

Katayama et al.

[11] Patent Number: 5,839,679

[45] Date of Patent: Nov. 24, 1998

[54] BOBBIN THREAD WINDING APPARATUS

[75] Inventors: Kazunori Katayama; Hiroyuki Tomioka; Toshinobu Shinozuka, all of Tokyo, Japan

[73] Assignee: Juki Corporation, Tokyo, Japan

[21] Appl. No.: 548,237

[22] Filed: Oct. 25, 1995

[30] Foreign Application Priority Data

| | | | |
|---|---|---|---|
| Oct. 26, 1994 | [JP] | Japan | 6-285932 |
| Feb. 8, 1995 | [JP] | Japan | 7-043452 |
| Feb. 27, 1995 | [JP] | Japan | 7-065140 |

[51] Int. Cl.[6] ..... B65H 75/32; B65H 63/00; B65H 54/18; D05B 57/10

[52] U.S. Cl. ..... 242/21; 112/186; 112/278; 112/279; 226/97.4; 242/20; 242/36; 242/125.1

[58] Field of Search ..... 242/20, 21, 125.2; 112/279, 186, 278, 273; 226/97.4

[56] References Cited

U.S. PATENT DOCUMENTS

| | | | |
|---|---|---|---|
| 2,808,795 | 10/1957 | Wortham | 112/186 X |
| 3,125,973 | 3/1964 | Bernerus et al. | 112/186 |
| 3,509,840 | 5/1970 | Rovin | 112/181 |
| 4,002,130 | 1/1977 | Rovin et al. | 112/186 X |
| 4,117,789 | 10/1978 | Rovin et al. | 242/20 X |
| 4,196,685 | 4/1980 | Tamura | 112/273 |
| 4,244,313 | 1/1981 | Rovin et al. | 242/20 X |
| 4,681,050 | 7/1987 | Kosmas | 112/186 X |
| 5,078,068 | 1/1992 | Hager et al. | 112/273 X |
| 5,143,004 | 9/1992 | Mardix et al. | 112/278 X |
| 5,350,127 | 9/1994 | Arnold et al. | 242/20 |

*Primary Examiner*—Michael Mansen
*Attorney, Agent, or Firm*—Morgan, Lewis & Bockius LLP

[57] ABSTRACT

A bobbin thread winding apparatus which can reliably twine a bobbin thread around the bobbin within the bobbin case. With the reliable twining of the thread, the thread is not cut and also will never be forced out of the bobbin case, thereby forming a good seam. Since the thread is not wound around a shaft other than the bobbin shaft, no manual operation is required for resetting the thread to the clamping mechanism, improving the reliability of the bobbin thread winding apparatus. The bobbin thread winding apparatus can accurately detect an effective thread winding amount of the bobbin thread irrespective of the yarn count of the thread used, and does not apply an excessive load to the thread winding mechanism, causing any adverse effect on the stitching quality. The bobbin thread winding apparatus allows a lower thread to be drawn out of the thread supply source and is then securely twisted around the bobbin shaft without a thread draw-out mechanism. Without the need to forcibly draw out the lower thread out of the thread supply source, the cost to manufacture the apparatus is reduced and its reliability is increased.

17 Claims, 17 Drawing Sheets

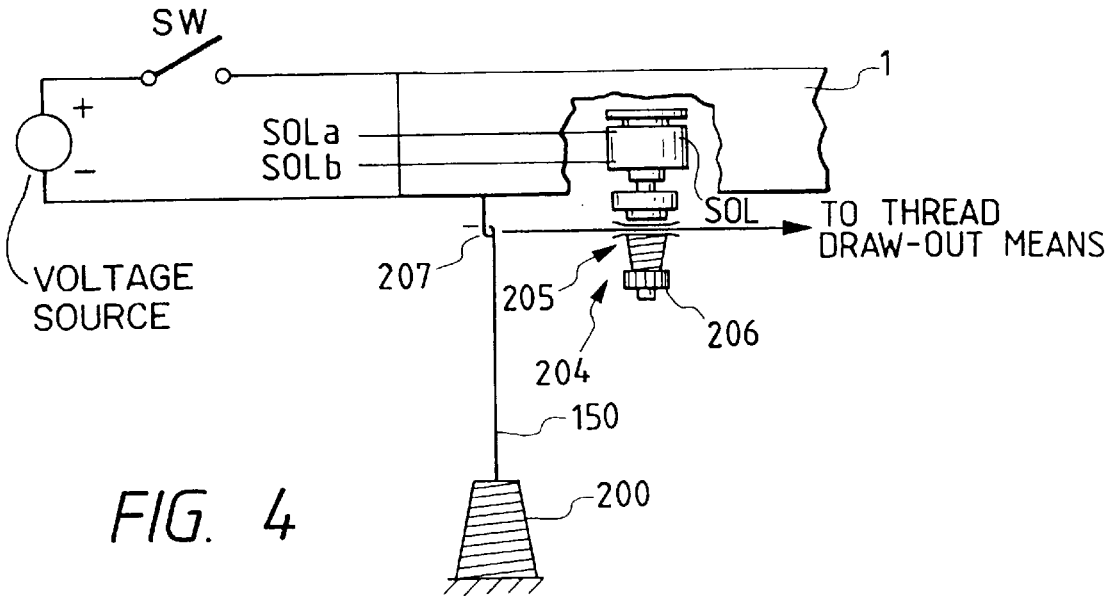
FIG. 4
FIG. 5
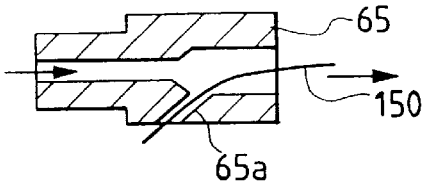
FIG. 6
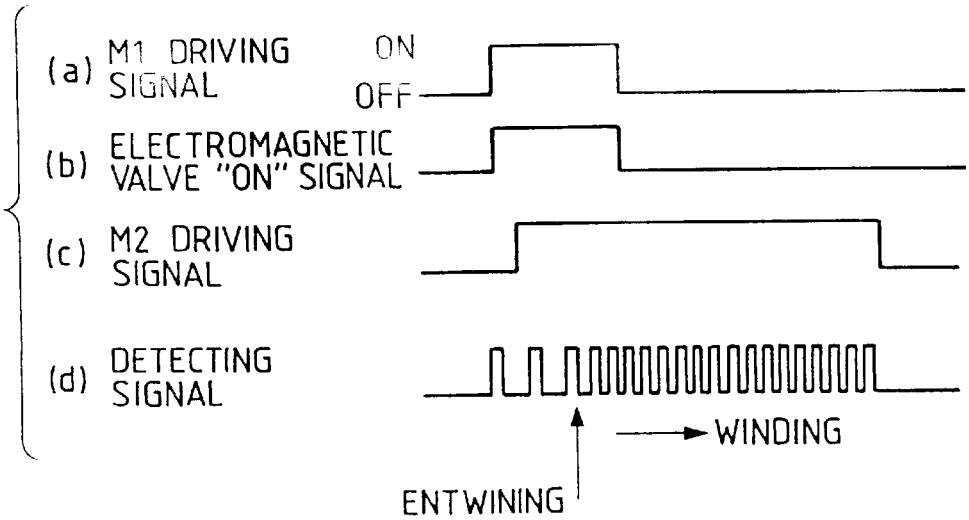

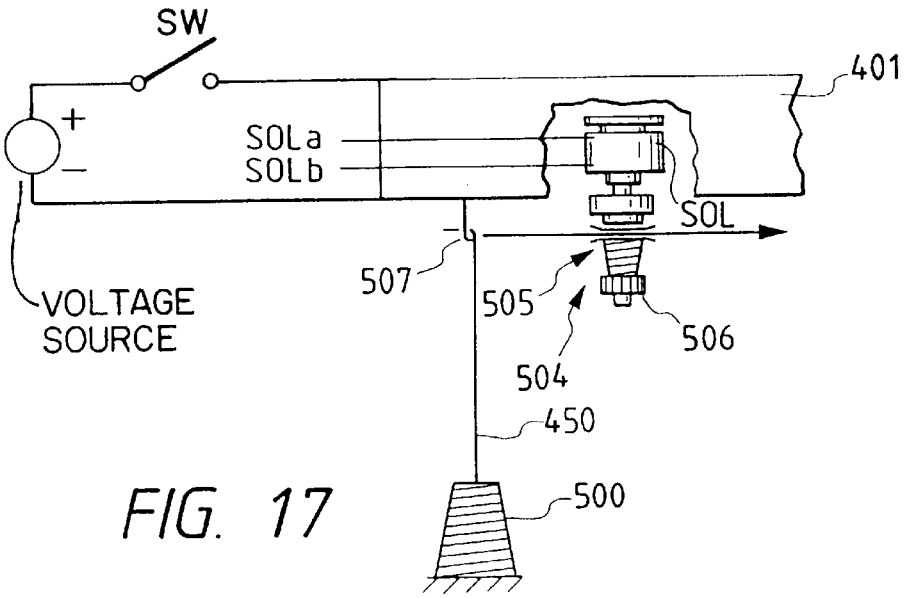
FIG. 17
FIG. 18
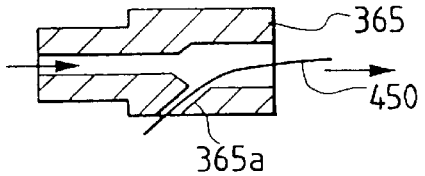
FIG. 19
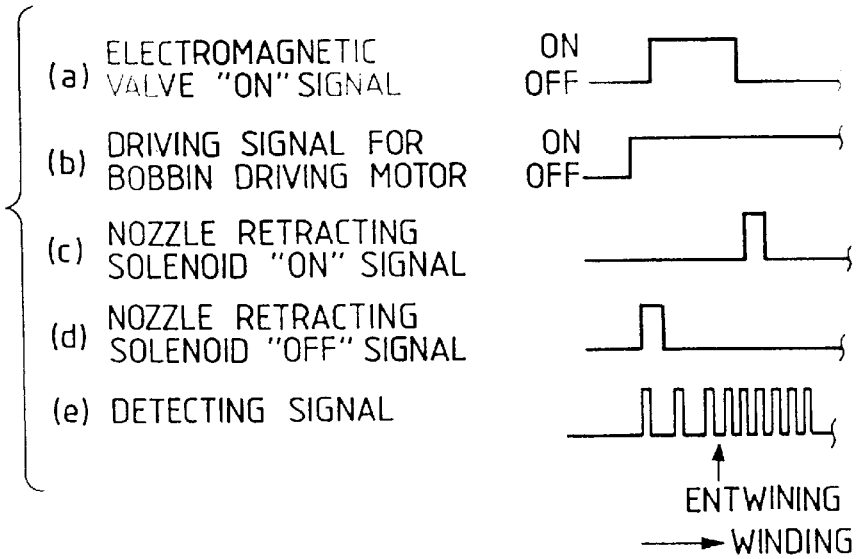

BOBBIN THREAD WINDING APPARATUS

BACKGROUND OF THE INVENTION

The present invention relates to an apparatus for winding a bobbin thread on a bobbin.

In the conventional sewing machine, when a bobbin thread wound on a bobbin is used up, an operator usually takes one of the following actions. In a first action, the operator takes a bobbin case containing an empty bobbin from a shuttle body, winds a bobbin thread on the empty bobbin, and loads it again into the shuttle body. In a second action, he takes the empty bobbin out of the shuttle body, and replaces the empty bobbin with a new one having a bobbin thread already wound thereon. Thus, the work of winding a bobbin thread and the work of replacing the empty bobbin with a new one are indispensable for the conventional sewing machine, and are time consuming and troublesome. To cope with this problem, there is proposed a sewing machine capable of automatically winding a bobbin thread on the bobbin and replacing an empty bobbin with a new one having the thread already wound thereon (Published Unexamined Japanese Patent Application No. Hei. 5-192476 and Japanese Patent Application No. Hei. 4-188688).

In the construction of the sewing machines disclosed in Published Unexamined Japanese Patent Application No. Hei. 5-192476 and Japanese Patent Application No. Hei. 4-188688, an operator clamps the end of a bobbin thread that is led from the bobbin, by a clamp mechanism, introduces the thread into the bobbin case, and turns the bobbin to cause the thread to twine and wind around the bobbin shaft. As a result, the thread clamped by the clamp mechanism is left outside the bobbin case after the thread winding operation is completed. If the final sewing is performed in this state, the thread left outside the bobbin case gets entangled or caught in the gap of the bobbin case. The resultant stitch is not good or in an extreme case, the thread is cut.

In the sewing machines constructed such that the end of the thread led from the bobbin is clamped with the clamp mechanism, there is the possibility that the thread slips off the clamp mechanism during the operation of the sewing machine. If so done, the thread must manually be set to the clamp mechanism. In this respect, the reliability of the machine is unsatisfactory.

Further, in those machines, sometimes introduction of the thread into the bobbin case fails. In this case, the thread is wound around a shaft other than the bobbin shaft, for example, the wind-up shaft or the bobbin case shaft of the bobbin thread winding apparatus. Also in this case, an operator must manually remove the thread from such a shaft and set it to the clamp mechanism. This leads to degradation of the reliability of the machine.

In connection with this, there is a proposal that a mechanism capable of detecting the amount of the thread wound on the bobbin is added to the bobbin thread winding apparatus as mentioned above (Published Unexamined Japanese Patent Application No. Hei. 5-239194). In the proposed machine, the thread winding amount is detected using the number of revolutions of the bobbin wind-up shaft for turning the bobbin. The number of revolutions of the bobbin wind-up shaft, which represents the thread winding amount, varies with the yarn count. For this reason, correction is made for threads other than the thread of the standard yarn count. However, the correction accuracy is actually unsatisfactory.

In the proposed machine, the thread is twined and wound around the bobbin shaft. The quantity of the thread wound is not used in an actual sewing operation, and the time of completing the twining operation is unknown. As a result, the thread winding amount is inexactly known.

SUMMARY OF THE INVENTION

Accordingly, an object of the present invention is to provide a bobbin thread winding apparatus which can reliably twine a bobbin thread around the bobbin within the bobbin case. With the reliable twining of the thread, the thread will never be forced out of the bobbin case, a good seam is formed, and the thread is not cut. Further, the thread end is not slipped off, the thread is not wound around a shaft other than the bobbin shaft, and hence any manual operation is not required for resetting the thread to the clamping mechanism. Accordingly, the reliability of the bobbin thread winding apparatus is improved.

Another object of the present invention is to provide a bobbin thread winding apparatus which can accurately detect an effective thread winding amount of the bobbin thread irrespective of the yarn count of the thread used, and does not apply an excessive load to the thread winding mechanism, whereby any adverse effect is not exerted on the stitching quality.

Further object of the present invention is to provide a bobbin thread winding apparatus in which a lower thread drawn out of the thread supply source gets securely twisted round the bobbin shaft without a thread draw-out mechanism for forcibly drawing a lower thread out of the thread supply source, whereby the cost to manufacture is reduced, and an apparatus reliability is increased.

To achieve the above objects, according to a first aspect of the invention, a bobbin thread winding apparatus includes: a bobbin case with holes along the circumferential edge thereof; a bobbin with a bobbin shaft on which a bobbin thread may be wound, said bobbin being rotatably disposed in the bobbin case; bobbin drive means for turning the bobbin in the bobbin case; thread draw-out means for drawing a bobbin thread from a thread supply source; and air guide means for guiding the bobbin thread, which is drawn out of the thread supply source by the thread draw-out means, to an opening of the bobbin case by an air stream, whereby the bobbin thread guided to the opening of the bobbin case is fed into the bobbin case by the draw-out operation of the thread draw-out means and the air by the air guide means, and the bobbin thread is twined round the bobbin shaft by the rotation of the bobbin caused by the bobbin drive means.

According to a second aspect, a bobbin thread winding apparatus includes: a bobbin case with holes along the circumferential edge thereof; a bobbin with a bobbin shaft on which a bobbin thread may be wound, said bobbin being rotatably disposed in the bobbin case; bobbin drive means for turning the bobbin in the bobbin case; insertion means for inserting the tip of the bobbin thread supplied from a thread supply source into the bobbin case through an opening of the bobbin case; bobbin drive control means for controlling the bobbin drive means so that the bobbin thread inserted into the bobbin case gets twisted round the bobbin shaft with the turn of the bobbin; and thread winding detecting means for detecting the start of winding the bobbin thread twisted round the bobbin shaft, whereby the bobbin thread that is inserted into the bobbin case through the opening of the bobbin case gets twisted round the bobbin shaft, with the turn of the bobbin driven by the bobbin drive means, and the twisting of the bobbin thread round the bobbin shaft is detected on the basis of the output signal of the thread winding detecting means.

According to a third aspect, a bobbin thread winding apparatus includes: a bobbin case with holes along the circumferential edge thereof; a bobbin with a bobbin shaft on which a bobbin thread may be wound, said bobbin being rotatably disposed in the bobbin case; bobbin drive means for turning the bobbin in the bobbin case; a draw-out roller, located between a thread supply source and the bobbin case, being rotatable while having the bobbin thread wound thereon; draw-out roller drive means for turning the draw-out roller at a speed lower than a bobbin speed of the bobbin turned by the bobbin drive means; a one-way clutch for connecting and disconnecting the draw-out roller to and from the draw-out roller drive means so as to allow the bobbin drive means to turn the draw-out roller; roller turn detecting means for detecting the turn of the draw-out roller; and air guide means for guiding the bobbin thread that is drawn out by the turn of the draw-out roller caused by the draw-out roller drive means, into an opening of the bobbin case by an air stream, whereby the bobbin thread that is guided to the opening of the bobbin case is fed into the bobbin case by the use of the turn of the draw-out roller caused by the draw-out roller drive means and an air stream caused by the air guide means, the bobbin thread gets twisted round the bobbin shaft with the bobbin driven by the bobbin drive means, and the twisting of the bobbin thread round the bobbin shaft is detected on the basis of the output signal of the roller turn detecting means.

According to a fourth aspect, a bobbin thread winding apparatus includes: a bobbin case with holes along the circumferential edge thereof; a bobbin with a bobbin shaft on which a bobbin thread may be wound, said bobbin being rotatably disposed in the bobbin case; bobbin drive means for turning the bobbin in the bobbin case; insertion means for inserting the tip of the bobbin thread supplied from a thread supply source into the bobbin case through an opening of the bobbin case; bobbin drive control means for controlling the bobbin drive means so that the bobbin thread inserted into the bobbin case gets twisted round the bobbin shaft with the turn of the bobbin; thread winding amount detecting means for detecting the amount of the bobbin thread that is wound around the bobbin shaft driven by the bobbin drive means; thread winding detecting means for detecting the start of winding the bobbin thread twisted round the bobbin shaft; and detect control means for carrying out such a control as to start the detection of the thread winding amount in response to the detection of the start of winding the bobbin thread.

According to a fifth aspect, a bobbin thread winding apparatus includes: a bobbin case with holes along the circumferential edge thereof; a bobbin with a bobbin shaft on which a bobbin thread may be wound, said bobbin being rotatably disposed in the bobbin case; bobbin drive means for turning the bobbin in the bobbin case; insertion means for inserting the tip of the bobbin thread supplied from a thread supply source into the bobbin case through an opening of the bobbin case; bobbin drive control means for controlling the bobbin drive means so that the bobbin thread inserted into the bobbin case gets twisted round the bobbin shaft with the turn of the bobbin; thread winding amount detecting means for detecting the amount of the bobbin thread that is wound around the bobbin shaft driven by the bobbin drive means; and thread supply amount determining means for determining the amount of the bobbin thread supplied from a thread supply source by the thread winding amount detecting means, whereby the bobbin thread that is inserted into the bobbin case through the opening of the bobbin case gets twisted round the bobbin shaft, with the turn of the bobbin driven by the bobbin drive means, and the amount of the bobbin thread supplied to the bobbin shaft is determined on the basis of the output signal of the thread supply amount determining means.

According to a sixth aspect, in the bobbin thread winding apparatus of the first aspect, the thread guide direction of the air guide means lies closer to the bobbin-shaft thread winding side of the circumference of the bobbin shaft than the segment connecting the center of the bobbin shaft and the tip of the air guide means.

According to a seventh aspect, a bobbin thread winding apparatus includes: a bobbin case with holes along the circumferential edge thereof; a bobbin with a bobbin shaft on which a bobbin thread may be wound, said bobbin being rotatably contained in the bobbin case; bobbin drive means for turning the bobbin in the bobbin case; thread insertion means for pulling a bobbin thread of such a length long enough to twine the thread round the bobbin shaft from a thread supply source, and inserting the pulled-out bobbin thread into the bobbin case through an opening of the bobbin case; and thread twining means for twining the bobbin thread that is inserted into the bobbin case by the thread insertion means round the bobbin shaft in cooperation with the turn of the bobbin caused by the bobbin drive means; whereby the bobbin thread is wound around the bobbin contained in the bobbin case by turning the bobbin shaft round entwined with the bobbin thread by the bobbin drive means.

According to a eighth aspect, in the bobbin thread winding apparatus of the seventh aspect, the thread insertion means is air guide means for guiding a bobbin thread supplied from the thread supply source to an opening of the bobbin case along a thread guide path, pulling out the bobbin thread of such a length long enough to twine the bobbin thread round the bobbin shaft, and inserting the pulled-out bobbin thread into the bobbin case through an opening of the bobbin case, with the aid of air stream.

According to a ninth aspect, in the bobbin thread winding apparatus of the seventh aspect, the thread twining means is an air means for causing an air stream in the bobbin case so that the bobbin thread introduced into the bobbin case by the thread insertion means gets twisted round the bobbin shaft.

According to a tenth aspect, the bobbin thread winding apparatus of the seventh aspect further includes thread hooking means for hooking to the bobbin case the bobbin thread that is wound around the bobbin shaft and led from the opening of the bobbin case, and allowing the bobbin thread to be led out under a thread tension spring.

According to a eleventh aspect, the bobbin thread winding apparatus of the seventh or tenth, further comprises cutting means for cutting the bobbin thread that is wound around the bobbin shaft and led out of the bobbin case, while leaving a preset amount of the wound bobbin thread, by a movement of the cutting means relative to the bobbin case; and a distance between a thread cutting point when the bobbin thread is cut by the cutting means and the fore end of the thread insertion means being substantially equal to the length long enough to twine the bobbin thread round the bobbin shaft.

According to a twelfth aspect, the bobbin thread winding apparatus of the seventh aspect, further includes moving means for moving the fore end of the thread insertion means between a work position in the vicinity of the opening of the bobbin case and a retract position located apart from the work position, wherein the fore end of the thread insertion means is moved apart from the work position by the moving means, and the bobbin thread is wound around the bobbin shaft.

According to a thirteenth aspect, the bobbin thread winding apparatus of the tenth aspect, further includes moving means for moving the fore end of the thread insertion means between a work position in the vicinity of the opening of the bobbin case and a retract position located apart from the work position, wherein the fore end of the thread insertion means is moved apart from the work position by the moving means, and the bobbin thread is hooked to the bobbin case.

According to a fourteenth aspect, the bobbin thread winding apparatus of the eleventh aspect, further includes moving means for moving the fore end of the thread insertion means between a work position in the vicinity of the opening of the bobbin case and a retract position located apart from the work position, wherein the fore end of the thread insertion means is moved apart from the work position by the moving means, and the bobbin thread is cut.

According to a fifteenth aspect, in the bobbin thread winding apparatus of any of the twelfth to fourteenth aspects, the fore end of the thread insertion means may be set at either of a work position and a retract position.

According t o a sixteenth aspect, in the bobbin thread winding apparatus of the ninth aspect, the direction of the air blown from the air means is closer to the thread-winding side of the outer surface of the bobbin shaft than a line that is prolonged from the tip of the air means, while passing through the center of the bobbin shaft.

According to a seventeenth aspect, the bobbin thread winding apparatus of the seventh aspect, further includes thread-twining detecting means for detecting the twining of the thread around the bobbin shaft, wherein the twining of the thread around the bobbin shaft is detected according to an output signal of the thread-twining detecting means.

According to a eighteenth aspect, in the bobbin thread winding apparatus of the seventeenth aspect, when the thread-twining detecting means fails to detect the twining of the thread around the bobbin shaft, the operation for twining the bobbin thread round the bobbin shaft is repeated or continued.

In the bobbin thread winding apparatus according to the first aspect, the bobbin thread is drawn out of the thread supply source by the thread draw-out means, and guided to the opening of the bobbin case by the air guide means. The thread guided to the bobbin case opening is further drawn out by the thread draw-out means, and fed into the bobbin case by an air stream from the air guide means. With the rotation of the bobbin caused by the bobbin drive means, the thread securely gets twisted round the bobbin case.

In the bobbin thread winding apparatus according to the second aspect, insertion means inserts the tip of the bobbin thread supplied from a thread supply source into the bobbin case through an opening of the bobbin case. The bobbin drive control means controls the bobbin drive means so that the bobbin thread inserted into the bobbin case gets twisted round the bobbin shaft with the turn of the bobbin. The twisting of the bobbin thread round the bobbin shaft is detected on the basis of the output signal of the thread winding detecting means.

In the bobbin thread winding apparatus according to the third aspect, a bobbin thread is drawn out of the thread supply source by the draw-out roller driven by the draw-out roller drive means. The thread drawn out is guided to the opening of the bobbin case by the air guide means. The thread guided to the opening is further drawn out of the thread supply source by the draw-out roller driven by the draw-out roller drive means. It is fed into the bobbin case by an air stream from the air guide means. With the turn of the bobbin caused by the bobbin drive means, the thread securely gets twisted round the bobbin shaft. The turn of the draw-out roller is detected by the roller turn detecting means. The speed of the draw-out roller is smaller than the speed of the bobbin. Therefore, when the thread gets twisted round the bobbin shaft, the one-way clutch interrupts the transmission of the rotation of the draw-out roller drive means to the draw-out roller. The output signal of the roller turn detecting means, which has been representative of the roller speed of the draw-out roller, is caused to indicate the bobbin speed. The twisting of the bobbin thread around the bobbin shaft, and the effective thread winding amount of the thread wound on the bobbin shaft are detected. The effective thread winding amount is set to be the amount of the thread that is wound on the bobbin shaft after the thread gets twisted round the bobbin shaft. And it depends on the rotation of the draw-out roller. With provision of the one-way clutch, a load of the draw-out roller drive means is not applied to the bobbin drive means.

In the bobbin thread winding apparatus according to the fourth aspect, insertion means inserts the tip of the bobbin thread supplied from a thread supply source into the bobbin case through an opening of the bobbin case. The bobbin drive control means controls the bobbin drive means so that the bobbin thread inserted into the bobbin case gets twisted round the bobbin shaft with the turn of the bobbin. The twisting of the bobbin thread round the bobbin shaft is detected on the basis of the output signal of the thread winding detecting means. When the start of winding the bobbin thread around the bobbin shaft is detected on the basis of the output signal of the thread winding detecting means, the thread winding amount detecting means starts to detect the amount of the thread wound around the bobbin shaft under control of the bobbin drive control means.

In the bobbin thread winding apparatus according to the fifth aspect, insertion means inserts the tip of the bobbin thread supplied from a thread supply source into the bobbin case through an opening of the bobbin case. The bobbin drive control means controls the bobbin drive means so that the bobbin thread inserted into the bobbin case gets twisted and wound around the bobbin shaft with the turn of the bobbin.

The amount of the thread wound around the bobbin shaft is detected by the thread winding detecting means. The thread supply amount determining means determines the amount of the bobbin thread supplied from a thread supply source by the thread winding amount detecting means, on the basis of the amount of the winding thread. It is possible to know an abnormal supply of the bobbin thread from the determined amount of the bobbin thread. Examples of the abnormal supply of the bobbin thread are a state that the thread is used up and a state that the thread gets entangled in the thread supply path.

The bobbin thread winding apparatus according to the sixth aspect, in which the thread guide direction of the air guide means lies closer to the thread-winding side on the circumference of the bobbin shaft than the segment connecting the center of the bobbin shaft and the tip of the air guide means. The thread fed into the bobbin case firmly gets twisted round the bobbin shaft by the cooperation of the air stream and the rotation of the bobbin shaft.

In the bobbin thread winding apparatus of the seventh aspect, thread insertion means pulls a bobbin thread of such a length long enough to twine the thread round the bobbin shaft from a thread supply source, and inserts the pulled-out bobbin thread into the bobbin case through an opening of the bobbin case. The thread twining means, in cooperation with the thread insertion means, twines the bobbin thread that is inserted into the bobbin case by the thread insertion means round the bobbin shaft. The bobbin drive means turns the bobbin shaft round entwined with the bobbin thread to wind the bobbin thread around the bobbin contained in the bobbin case. With such a construction, in the subsequent operation, a bobbin thread supplied from the thread supply source securely gets twisted round the bobbin shaft and is wound around the bobbin shaft, without a mechanism for forcibly drawing the thread out of the thread supply source.

In the bobbin thread winding apparatus of the eight aspect, the air guide means is used for the thread insertion means in the seventh aspect. With the air guide means, a bobbin thread supplied from the thread supply source is guided to an opening of the bobbin case along a thread guide path. The bobbin thread of such a length long enough to twine the bobbin thread round the bobbin shaft is pulled out, and the pulled-out bobbin thread is inserted into the bobbin case through an opening of the bobbin case, with the aid of air stream.

In the bobbin thread winding apparatus of the ninth aspect, the air means is used for the thread twining means in the seventh aspect. The bobbin thread introduced into the bobbin case by the thread insertion means gets twisted round the bobbin shaft, with the aid of an air stream caused by the air means and the turn of the bobbin caused by the bobbin drive means.

In the bobbin thread winding apparatus of the tenth aspect, the bobbin thread that is wound around the bobbin shaft and led from the opening of the bobbin case, is hooked to the bobbin case by the thread hooking means, and is led out under a thread tension spring.

In the bobbin thread winding apparatus of the eleventh aspect, the cutting means, which moves relative to the bobbin case, cuts the bobbin thread that is wound around the bobbin shaft and led out of the bobbin case (corresponding to the bobbin thread led from the opening of the bobbin case in the seventh aspect, and the bobbin thread led under the tension spring in the eleventh aspect), while leaving a preset amount of the wound bobbin thread. A distance between a thread cutting point when the bobbin thread is cut by the cutting means and the fore end of the thread insertion means is substantially equal to the length long enough to twine the bobbin thread round the bobbin shaft. With this construction, after the thread is cut, the fore end of the thread insertion means surely provides the thread of the length long enough to twine the bobbin thread round the bobbin shaft. Accordingly, in the subsequent operation, a bobbin thread supplied from the thread supply source securely gets twisted round the bobbin shaft and is wound around the bobbin shaft, without a mechanism for forcibly drawing the thread out of the thread supply source.

In the bobbin thread winding apparatus of the twelfth aspect, when the bobbin thread is wound around the bobbin shaft, the fore end of the thread insertion means is moved apart from the work position by the moving means. Therefore, a distance between the fore end of the thread insertion means and the bobbin shaft is increased, so that the bobbin thread is uniformly wound over the entire length of the bobbin shaft.

In the bobbin thread winding apparatus of the thirteenth aspect, when and the bobbin thread that is led from the opening of the bobbin case is hooked to the bobbin case, the fore end of the thread insertion means is moved apart from the work position by the moving means. Therefore, no interference of the fore end of the thread insertion means with the hooking means takes place.

In the bobbin thread winding apparatus of the fourteenth aspect, when the bobbin thread is cut, the fore end of the thread insertion means is moved apart from the work position by the moving means. Therefore, no interference of the fore end of the thread insertion means with the thread cutting means takes place.

In the bobbin thread winding apparatus of the fifteenth aspect, the fore end of the thread insertion means may be set at either of a work position and a retract position. When the bobbin thread is cut, for example, the fore end of the thread insertion means is distanced from the work position and the retract position so that a distance between a thread cutting point when the bobbin thread is cut by the cutting means and the fore end of the thread insertion means is substantially equal to the length enough to twine the bobbin thread round the bobbin shaft. When the thread is wound, for example, the fore end of the thread insertion means is moved to the retract position so as to maximize the distance between it and the bobbin shaft, so that the bobbin thread is uniformly wound over the entire length of the bobbin shaft.

In the bobbin thread winding apparatus of the sixteenth aspect, the direction of the air blown from the air means is closer to the thread-winding side of the outer surface of the bobbin shaft than a line that is prolonged from the tip of the air means, while passing through the center of the bobbin shaft. Therefore, the bobbin thread inserted into the bobbin case securely gets twisted round the bobbin shaft with the aid of the air stream and the turn of the bobbin shaft.

In the bobbin thread winding apparatus of the seventeenth aspect, the thread-twining detecting means detects the twining of the thread around the bobbin shaft. Therefore, the amount of the thread after it twines round the bobbin shaft is detected as the amount of the wound bobbin thread, for example.

In the bobbin thread winding apparatus of the eighteenth aspect, when the thread-twining detecting means fails to detect the twining of the thread around the bobbin shaft, the operation for twining the bobbin thread round the bobbin shaft is repeated or continued. Through the repeating and continuous twining operation, the possibility that the thread twines round the bobbin shaft is improved.

BRIEF DESCRIPTION OF THE DRAWINGS

FIG. 4 is a front view showing a thread tension varying means incorporated into the first embodiment of the present invention;

FIG. 5 is a cross sectional view showing a thread absorber used in the bobbin thread winding apparatus of FIG. 1;

FIG. 6 is a timing chart showing the operation of the bobbin thread winding apparatus;

FIG. 17 is a front view showing a thread tension varying means incorporated into the second embodiment of the present invention;

FIG. 18 is a cross sectional view showing a thread absorber used in the bobbin thread winding apparatus of FIG. 14;

FIG. 19 is a timing chart showing the operation of the bobbin thread winding apparatus;

DETAILED DESCRIPTION OF THE PREFERRED EMBODIMENTS

The preferred embodiment of the present invention will be described in detail with reference to the accompanying drawings. An automatic bobbin thread supplying apparatus which uses a bobbin thread winding apparatus according to the present invention will be described with reference to FIGS. 7 through 11.

Figure 7:
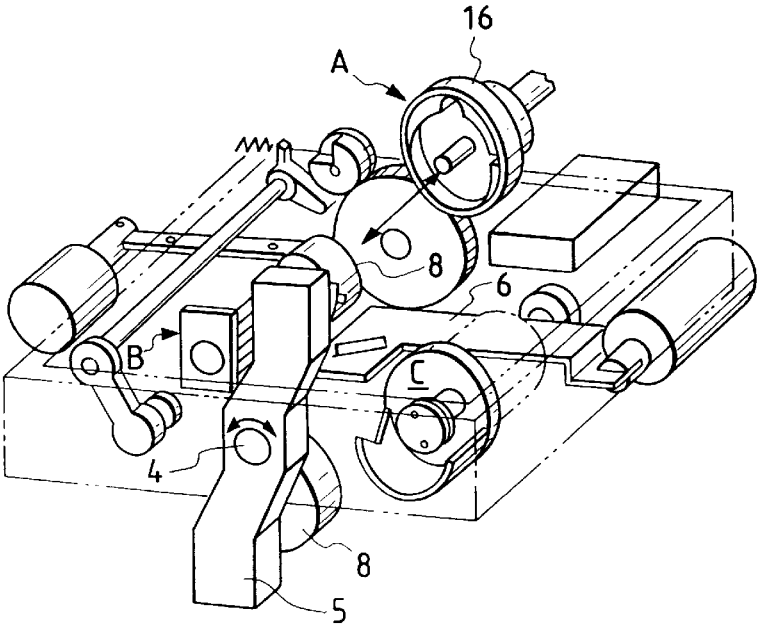
FIG. 7 is a perspective view showing an automatic bobbin thread supplying apparatus into which the bobbin thread winding apparatus of FIG. 1 is incorporated.
Figure 8:
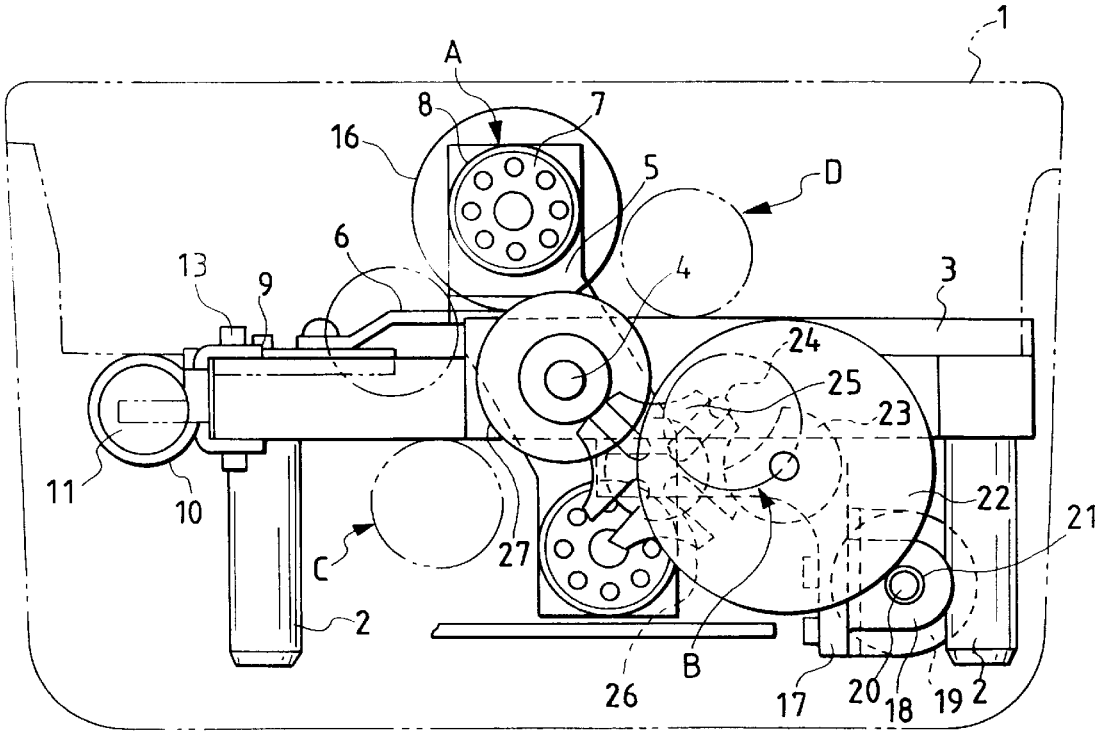
FIG. 8 is a front view showing the automatic bobbin thread supplying apparatus of FIG. 7.
Figure 9:
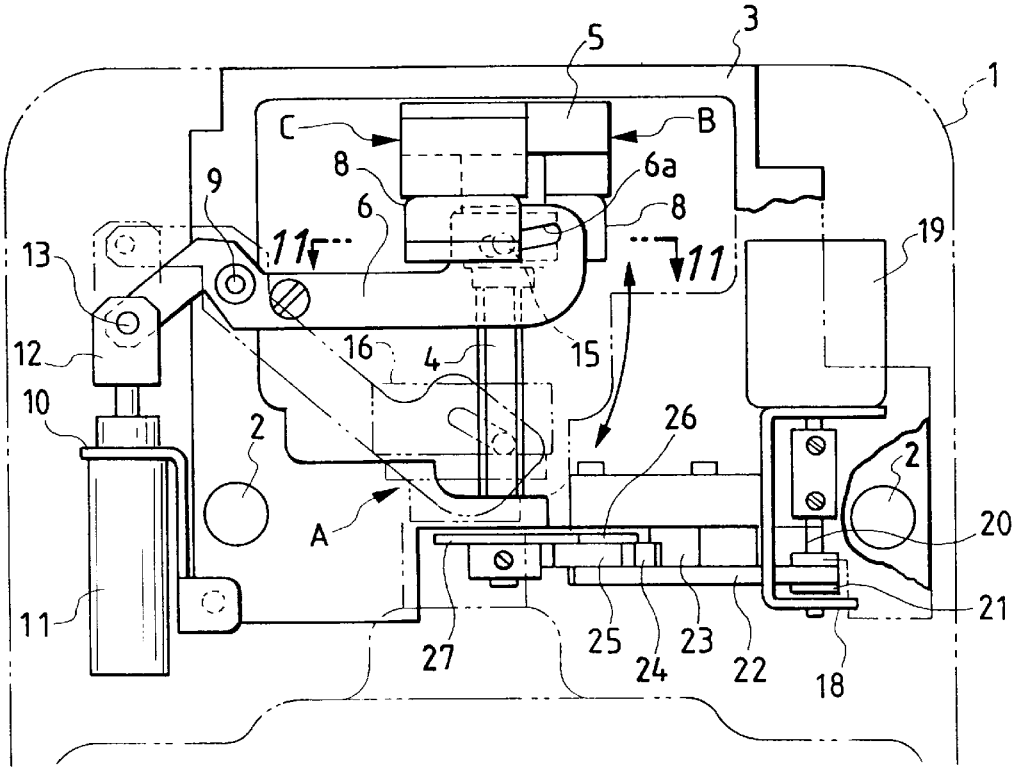
FIG. 9 is a plan view showing the automatic bobbin thread supplying apparatus of FIG. 7.

The automatic bobbin thread supplying apparatus is disposed in a space under a sewing machine bed 1 which has an oil reservoir at the bottom. As shown in FIGS. 7 and 8, a bobbin case exchanging position A, a residual thread removing position B and a bobbin thread winding position C are disposed around a shaft while being angularly spaced at 120° from one another. As shown in FIGS. 7 to 9, in connection with the bobbin case exchanging position A, the residual thread removing position B, and the bobbin thread winding position C, a couple of support rods 2 are disposed on both sides of the shaft. A main base 3 is mounted on the support rods 2. The above shaft designated by reference numeral 4 is horizontally supported by the main base 3. The shaft 4 serves as a guide shaft. A rotary arm 5, together with the guide shaft 4, is rotatable, and it is axially slidable. A lever 6 forwardly and backwardly moves the rotary arm 5 along the guide shaft 4. Driving means for turning the rotary arm 5 in the steps of 60° in forward and reverse directions is further provided.

Figure 10:
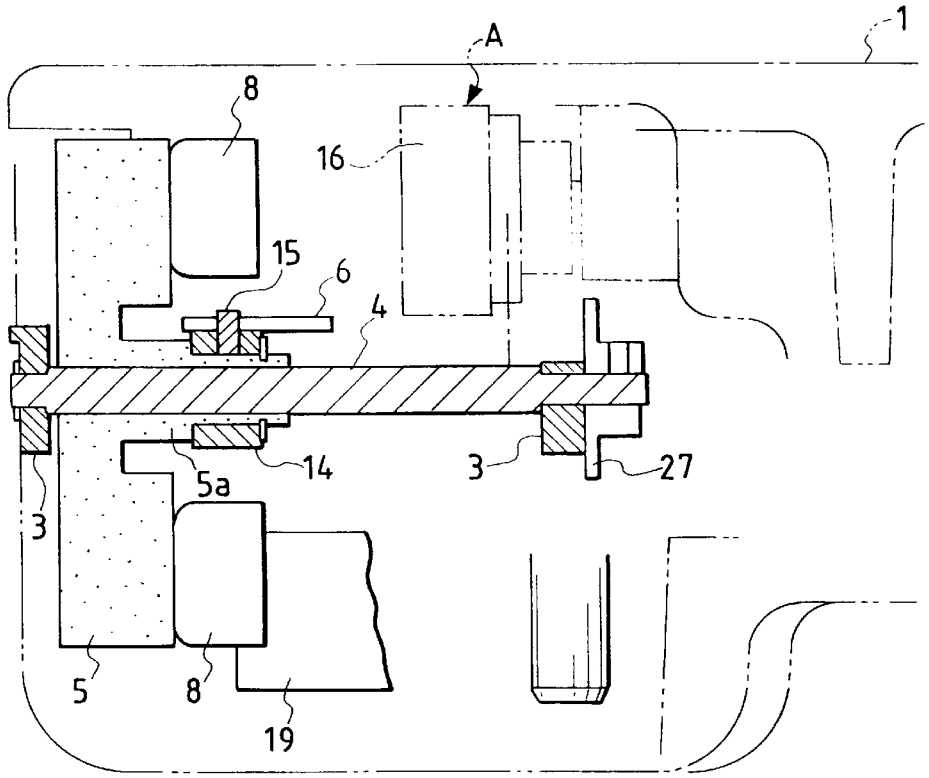
FIG. 10 is a side view showing the automatic bobbin thread supplying apparatus of FIG. 7.
Figure 11:
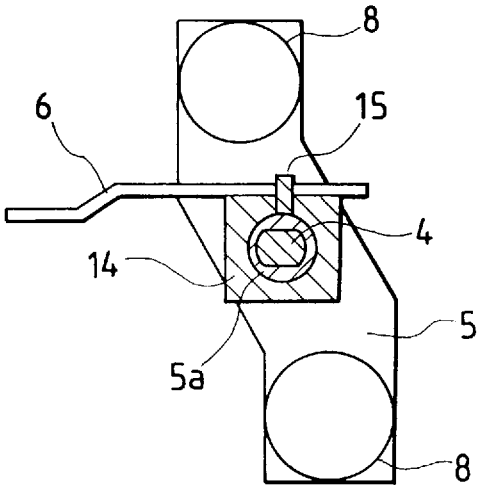
FIG. 11 is a front view showing a layout of a rotary arm, a lever, and a guide shaft in the automatic bobbin thread supplying apparatus.

The guide shaft 4, as best illustrated in FIG. 10, is rotatably supported at both ends by the upright parts of the main base 3. The guide shaft 4 is non-circular in cross section as shown in FIG. 11. The hole of a boss 5*a* of the rotary arm 5 is also non-circular. Accordingly, the rotary arm 5 is slidable along the guide shaft 4 and rotatable together with the guide shaft 4.

The rotary arm 5 is bent to be symmetrical in shape with respect to the center thereof (FIG. 7). A bobbin case 8 containing a bobbin 7 is removably attached to both ends of the rotary arm 5 (FIG. 10). A bobbin attaching/detaching mechanism for the rotary arm 5 may be the paired electromagnetic heads, which are used in the automatic bobbin thread supplying apparatus disclosed in Published Unexamined Japanese Patent Application No. Hei. 5-192476 or the bobbin exchanging apparatus for a sewing machine disclosed in Japanese Patent Application No. Hei. 5-121960, filed by the Applicant of the present Patent Application, or may be the mechanism using a lever pawl used by a bobbin exchanging apparatus for a sewing machine disclosed in Japanese Patent Application No. Hei. 5-116363, filed by the Applicant of the present Patent Application. In other words, any means capable of attaching and detaching the bobbin case 8 to and from the component (e.g., a shuttle body 16) that is located facing the bobbin case 8 may be used for the bobbin attaching/detaching mechanism.

The forward/backward moving lever 6 is rotatably supported by a shaft 9 upright on the main base 3 (FIGS. 8 and 9). An elongated hole 6*a* is formed in the free end of the lever 6. The other end of the lever 6 is rotatably supported by a shaft 13. The shaft 13 is fastened to a knuckle 12 formed at the top end of the rod of an air cylinder 11. The air cylinder 11 is fastened to the main base 3 with the aid of a support plate 10. An engaging pin 15 is inserted into the elongated hole 6*a* of the forward/backward moving lever 6 as shown in FIGS. 10 and 11. The engaging pin 15 protrudes from the surface of a collar 14. The collar 14 is rotatably mounted on the boss 5*a* of the rotary arm 5. With this connection structure, when the rod of the air cylinder 11 is moved forwardly and backwardly, the forward/backward moving lever 6 is turned about the shaft 9 forwardly and reversely. With the movement, the rotary arm 5 moves forwardly and backwardly along the guide shaft 4, with the engaging pin 15 engaging with the elongated hole 6*a* of the forward/backward moving lever 6. Thus, the rotary arm 5 is forwardly and backwardly movable along the guide shaft 4 between two locations: one containing the bobbin case exchanging position A as a sewing position where the shuttle body 16 is disposed (FIGS. 7 and 10) and the other containing the residual thread removing position B and the bobbin thread winding position C.

A drive mechanism for driving the rotary arm 5, as shown in FIGS. 8 and 9, is formed of a motor 19, a gear 21, a gear 22, a Geneva mechanism, a gear 26, and a gear 27. The motor 19 is mounted on a bracket 18 fastened to a bracket 17 extended downward from the main base 3. The gear 21 is securely fixed to the rotary shaft 20. The gear 22 is in mesh with the gear 21, which is rotatably supported by the bracket 17. The Geneva mechanism includes a driver 23 fixed securely to one side of the gear 22, a pin 24, and a follower 25 rotatably supported by the bracket 17. The gear 26 is securely fixed to the follower 25 in a coaxial fashion. The gear 27 is in mesh with the gear 26 while being secured to the guide shaft 4 (FIG. 10). When the gear 26 and the gear 27 is designed to have a preset gear ratio, the rotary arm 5 is turned in the steps of 60° about the guide shaft 4 by the motor 19 as a drive source and the Geneva mechanism in the drive mechanism.

Any suitable apparatus for removing the residual thread in the bobbin is available for the residual thread removing position B. Specific examples of the residual thread removing apparatus are the residual thread removing apparatus for bobbins disclosed in Japanese Patent Application Nos. Hei. 5-203610 and 6-40351, filed by the applicant of the present Patent Application. Any type apparatus other than the above ones is available for the residual thread removing position B, if it has such a function that a thread drawing-out means for drawing a thread out of the bobbin 7 is operated in a state that the bobbin case is held, and the bobbin 7 is turned by the thread drawing-out means, so that the thread is drawn out of the bobbin 7.

In the automatic bobbin thread supplying apparatus thus constructed, by the drive of the motor 19, the rotary arm 5 is forwardly or reversely turned in the steps of 60° and forwardly or backwardly moved along the guide shaft 4. By repeating the motions of the rotary arm 5, the bobbin case 8 is moved to the work positions A, B and C and undergoes necessary processings.

It is assumed that one end of the rotary arm 5 does not hold a bobbin case 8, and the other end thereof holds a bobbin case 8 containing a bobbin 7 (to be described later) with a thread wound therearound by the bobbin thread winding apparatus, and the one end of the bobbin case 8 is located at a position D between the work positions A and B (FIG. 8). In this state, a given sewing operation ends. Then, the rotary arm 5 is turned counterclockwise in the steps of 60° (FIG. 8), while at the same time it is moved toward the shuttle body (FIG. 7). And the bobbin case 8 containing the bobbin with the residual thread is pulled out of the shuttle body 16 that is located at the bobbin case exchanging position A, and is held by the one end of the rotary arm 5.

Then, the rotary arm 5 moves backward to the retract position of the guide shaft 4 while at the same time is turned 60°, and it moves forward. Then, the bobbin case 8 containing the bobbin not having the thread, which is held by the other end of the rotary arm 5, is put into the shuttle body 16, located at the bobbin case exchanging position A. Then, the rotary arm 5 retracts therefrom while being turned 60° counterclockwise (FIG. 8), so that the bobbin case 8 containing the bobbin having the residual thread, which is held by the other end of the rotary arm 5, advances to the residual thread removing position B. In this position, the residual thread is removed from the bobbin 7 by the residual thread removing apparatus, so that the bobbin is empty. Thereafter, the rotary arm 5 is turned counterclockwise 1800 (FIG. 8), and retracts therefrom, and then the bobbin case 8 containing the empty bobbin advances to the bobbin thread winding position C. In this position, a thread is wound on the empty bobbin. Subsequently, the sequence of the operations is repeated.

A bobbin thread winding apparatus according to the present invention will be described with reference to FIGS. 1 through 5. The bobbin thread winding apparatus is used in a state that it is installed at the bobbin thread winding position C of the automatic bobbin thread supplying apparatus.

Figure 1:
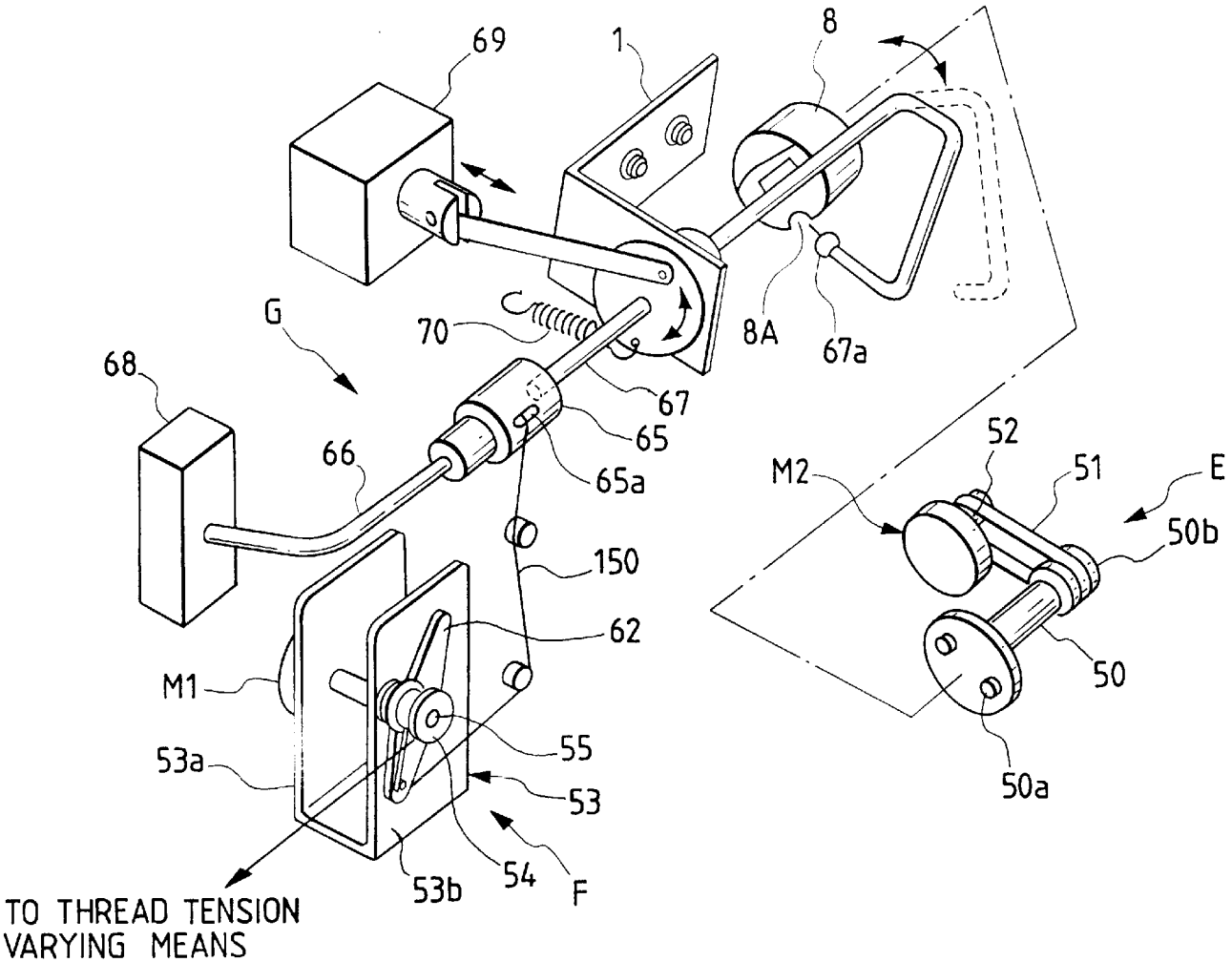
FIG. 1 is a perspective view showing a bobbin thread winding apparatus of the present invention.
Figure 2:
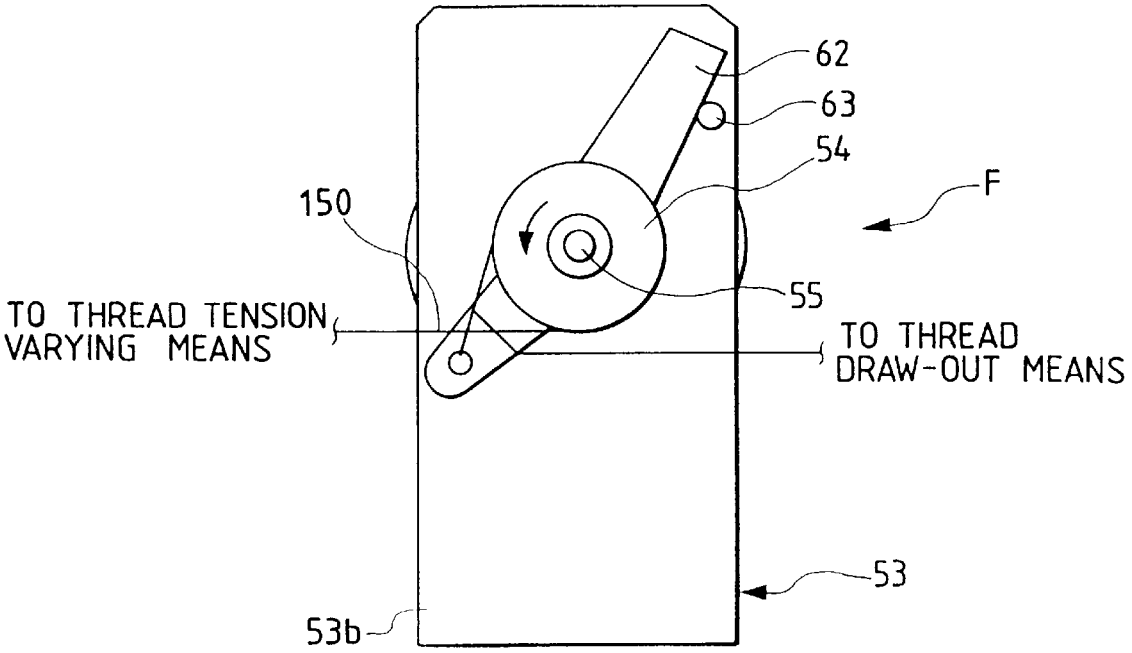
FIG. 2 is a front view showing a thread draw-out mechanism in the bobbin thread winding apparatus of FIG. 1.
Figure 3:
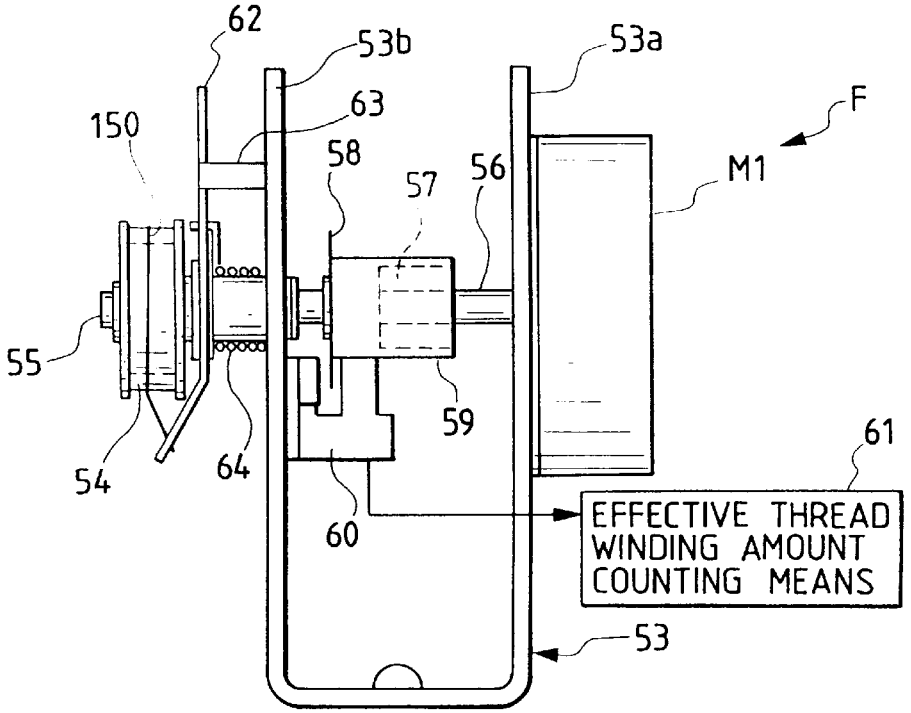
FIG. 3 is a side view showing the draw-out mechanism in the bobbin thread winding apparatus of FIG. 1.

The bobbin thread winding apparatus is provided with bobbin driving means E for turning the bobbin 7. The bobbin thread winding apparatus follows. In FIG. 1, reference numeral 50 designates a winding shaft. The winding shaft 50 is rotatably supported by a base, not shown. A clutch mechanism 50*a* is fastened to one end of the winding shaft 50. The clutch mechanism 50*a* is provided at one end of the winding shaft 50. The clutch mechanism 50*a* engages or disengages with or from a plural number of holes already formed in the bobbin 7. A pulley 50*b* is fixed securely to the other end of the winding shaft 50. A bobbin drive motor M2 is also fastened to the base. A pulley 52 is firmly attached to the output shaft of the bobbin drive motor M2. A belt 51 is stretched between the pulleys 52 and 50*b*.

The rotary arm 5 is turned and the bobbin case 8 is moved to and reaches the bobbin thread winding position C. Then, the rotary arm 5 advances and the bobbin case 8 also advances. The bobbin drive motor M2 is driven to turn, so that the clutch mechanism 50*a* is coupled with bobbin 7. The clutch mechanism used is constructed so as to engage or disengage with or from the holes. It is evident that the clutch mechanism may take any other suitable construction than the above one.

The bobbin thread winding apparatus is provided with a draw-out mechanism F for drawing a bobbin thread 150 out of a thread winder 200 (FIG. 4). The draw-out mechanism F follows. Reference numeral 53 designates a base in FIGS. 1 to 3. The base 53 is shaped like a U in cross section. A draw-out motor M1 as draw-out roller drive means is fastened to a side plate 53*a* of the base 53. The output shaft 56 of the draw-out motor M1 passes through the side plate 53*a*. The motor speed of the draw-out motor M1 is smaller than that of the bobbin drive motor M2. A draw-out roller shaft 55 is rotatably supported by another side plate 53*b* of the base 53. The draw-out roller shaft 55 is aligned with the output shaft 56 of the draw-out motor M1. A draw-out roller 54 is fastened to an end part of the draw-out roller shaft 55, which is somewhat closer to the draw-out motor M1. One turn of the bobbin thread 150, which is led from the thread winder 200, is put on the draw-out roller 54. A one-way clutch 57 intervenes between the output shaft 56 of the draw-out motor M1 and the draw-out roller shaft 55. The one-way clutch 57 connects the shaft 56 with the shaft 55 or disconnects the former from the latter. The one-way clutch 57 is contained in a sleeve 59. A detection slit member 58 is firmly attached to the sleeve 59.

The one-way clutch 57 operates such that when the rotation speed of the draw-out roller shaft 55 exceeds that of the output shaft 56 of the draw-out motor M1, the one-way clutch 57 disconnects the output shaft 56 of the draw-out motor M1 from the draw-out roller shaft 55.

The detection slit member 58 is shaped like a disc. A groove is formed in the circumferential part of the disc-like detection slit member 58. A photo sensor 60 as roller rotation detecting means is disposed at a location facing the detection slit member 58. The photo sensor 60 detects the groove of the detection slit member 58. In other words, the photo sensor 60 senses a rotation of the draw-out roller 54.

In the draw-out mechanism F thus constructed, the photo sensor 60 is coupled with an effective thread winding amount counting means 61, which detects the twine wound around the bobbin shaft and also detects the effective amount of the thread wound around the bobbin shaft. The effective thread winding amount counting means 61 will be described in detail later.

A looseness correcting mechanism for correcting a looseness of the bobbin thread 150 is additionally provided in the draw-out mechanism F. The looseness correcting mechanism includes a looseness correcting lever 62, a spring 64, and a stopper 63. The looseness correcting lever 62 is rotatably supported by the draw-out roller shaft 55 with a bearing (not shown) intervening therebetween. The bobbin thread 150 passes through looseness correcting lever 62. The spring 64 urges the looseness correcting lever 62 so as to remove a looseness of the bobbin thread 150. The stopper 63 stops the turn of the looseness correcting lever 62, which is caused by the urging force of the spring 64.

The bobbin thread winding apparatus is provided with an air guiding means G for guiding the bobbin thread 150, which is pulled out by the draw-out mechanism F, to an opening 8A of the bobbin case 8. The air guiding means G follows. In FIG. 1, reference numeral 65 designates a thread absorber 65 shaped like a tube. An absorbing hole 65*a* is formed in the thread absorber 65, as shown in FIGS. 1 and 5. The absorbing hole 65*a*, which connects to the exterior, is directed in the higher part of the string flow. One end of an air tube 66, which communicates with the inner space of the thread absorber 65, is coupled with the upstream part of the thread absorber 65. The other end of the air tube 66 is connected to an electromagnetic valve 68, which is connected to an air source, not shown. A thread applying switch, not shown, is provided, which is used for turning on and off the electromagnetic valve 68.

Figure 12:
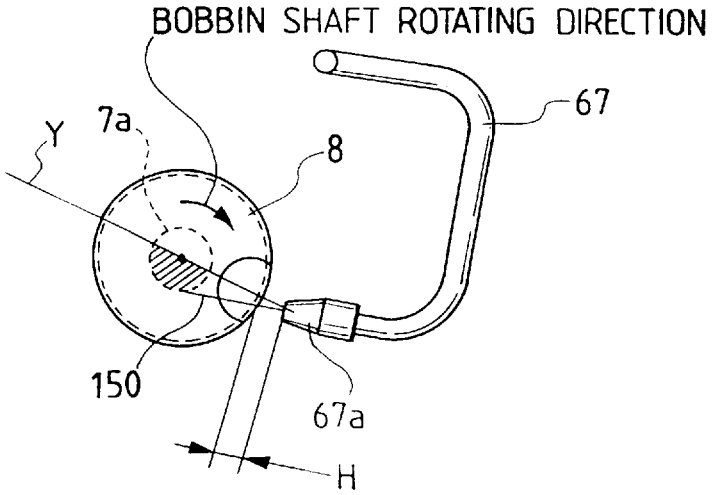
FIG. 12 shows a location of air guiding means relative to a bobbin case, and a bobbin shaft.
Figure 13:
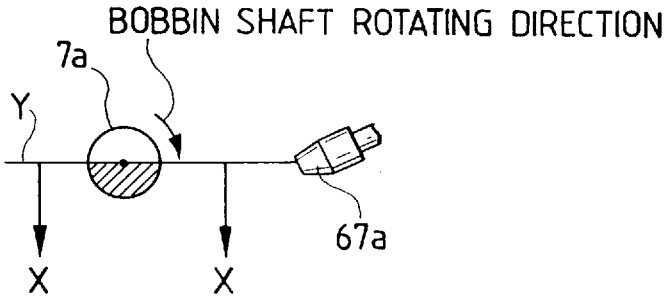
FIG. 13 is a view for explaining the thread-winding side of the bobbin shaft.

One end of an air tube 67, which communicates with the inner space of the thread absorber 65, is connected to the downstream part of the thread absorber 65, and rotatable about the thread absorber 65. The other end part of the air tube 67 is bent to have a shape of a U. The air tube 67 is disposed so that an air nozzle 67*a* at the other end thereof faces the opening 8A of the bobbin case 8 in a state that the clutch mechanism 50*a* is coupled with the bobbin 7. As shown in FIGS. 12 and 13, the thread guide direction of the tip of the air nozzle 67*a* (the tip of the air guiding means G) when it stops at the position (referred to as a facing position) where it faces the opening 8A of the bobbin case 8 lies on the thread-winding side of the bobbin shaft.

The "thread-winding side of the bobbin shaft" indicates one side of the bobbin shaft segmented by a line Y that is prolonged from the tip of the air nozzle 67*a*, while passing through the center of the bobbin shaft, viz., the side (indicated by arrows X) of the bobbin shaft 7*a* which receives the bobbin thread 150 (FIG. 13). The thread guide direction of the tip of the air nozzle 67*a* is preferably the direction in which a line prolonged from the tip of the air nozzle 67*a* intersects the circumference of the bobbin shaft 7*a* on the bobbin-shaft thread winding side X, more preferably the direction in which a line prolonged from the tip of the air nozzle 67*a* touches a point on the circumference of the bobbin shaft 7*a*.

When the electromagnetic valve 68 is turned on, air is supplied from the air source, travels through the air tube 66, the thread absorber 65, and the air tube 67, and is blown out of the air nozzle 67*a*. A distance H between the top of the air nozzle 67*a* which stops at the facing position and the opening 8A of the bobbin case 8 (FIG. 12) is preferably 10 mm or less, more preferably 3 to 7 mm. If the distance is selected to be within this range, the bobbin thread 150 is flapped by the air blown out, and an eddy current necessary for the bobbin thread 150 to twine round the bobbin shaft 7*a* within the bobbin case 8 is formed.

A mid part of the air tube 67 is rotatably supported by the sewing machine bed 1 of the bobbin thread winding apparatus. The air tube 67 is urged clockwise (FIG. 1) by a spring 70. When it is driven by a nozzle retracting solenoid 69, it is turned resisting the urging force of the spring 70. When the nozzle retracting solenoid 69 is in an ON state, the air nozzle 67*a* retracts from the opening 8A of the bobbin case 8 while resisting the urging force of the spring 70. When it is in an OFF state, the air nozzle 67*a* is moved to the facing position where it faces the opening 8A of the bobbin case 8, by the urging force of the spring 70.

A thread tension varying means 204, which varies a tension of the bobbin thread 150, is provided between the draw-out mechanism F and the thread winder 200 (FIG. 4). The thread tension varying means 204 is formed of a tension spring 205 for pushing the passing bobbin thread 150, a screw 206 for manually adjusting a pushing force of the tension spring 205, and a solenoid SOL, disposed within the sewing machine bed 1, for causing solenoid propelling force that resists the pushing force of the tension spring 205.

An electric circuit for driving the thread tension varying means 204 is constructed such that a power source V is connected in series to the solenoid SOL, and a switch SW is inserted therebetween.

When the switch SW is turned off, the solenoid propelling force is generated. In this state, a maximum of pushing force of the tension spring 205 acts on the bobbin thread 150, and the thread tension is at its maximum. When the switch SW is turned on, a maximum of propelling force is generated. In this state, the result of subtracting the solenoid propelling force from the pushing force of the tension spring 205 acts on the bobbin thread 150. The thread tension is at its minimum.

The operation of the bobbin thread winding apparatus thus constructed will be described with reference to FIGS. 1 through 6.

To start with, the bobbin thread 150 is led from the thread winder 200 and the thread tension varying means 204, and wound on the draw-out roller 54 by one turn, and is passed through a hole of the looseness correcting lever 62. At this time, the switch SW of the thread tension varying means 204 is turned on, to generate the solenoid propelling force and hence to decrease the thread tension to the minimum.

Then, the tip of the bobbin thread 150 is inserted into the absorbing hole 65*a* of the thread absorber 65, and is slightly pushed into the absorbing hole 65*a*. Subsequently, the draw-out motor M1 is driven to draw out the bobbin thread 150, while at the same time the electromagnetic valve 68 is temporarily turned on to supply air to the air tubes 66 and 67, from the air source. The bobbin thread 150 that has been put into the absorbing hole 65*a* is guided into the air nozzle 67*a* with the aid of the air stream till the thread tip appears out of the air nozzle 67*a*. Alternatively, a thread applying switch, not shown, for turning on and off the electromagnetic valve 68 is operated to cause an air stream in the air tubes 66 and 67 for a fixed period of time. With the aid of the air stream, the thread tip automatically appears out of the air nozzle 67*a*.

The rotary arm 5 is turned to move the bobbin case 8 to the bobbin thread winding position C, and is moved forward to move the bobbin case 8 forward. The bobbin drive motor M2 is temporarily driven to couple the clutch mechanism 50*a* with the bobbin 7. Then, the nozzle retracting solenoid 69 is turned off to move the air nozzle 67*a* to the opening 8A of the bobbin case 8.

Afterwards, the draw-out motor M1 is driven to draw out the bobbin thread 150. The electromagnetic valve 68 is turned on. Air is fed from the air source into the air tubes 66 and 67. The thread end appearing at the air nozzle 67*a* is guided into the bobbin case 8, while an eddy current is formed in the bobbin case 8. Substantially simultaneously with or with a slight time lag, the bobbin drive motor M2 is driven to turn the bobbin 7 (lines (a) and (c) of FIG. 6).

The bobbin thread 150 led into the bobbin case 8 twines round the bobbin shaft and is wound on the bobbin shaft. A rotation of the draw-out roller 54 is detected by the photo sensor 60, as already referred to. Before the bobbin thread 150 twines round the bobbin shaft, a rotation of the draw-out motor M1 is detected. As the bobbin thread 150 twines round the bobbin shaft, and is progressively wound around the bobbin shaft, the one-way clutch 57 interrupts the transmission of the rotation of the output shaft 56 of the draw-out motor M1 to the draw-out roller shaft 55 since the motor speed of the draw-out motor M1 is set to be smaller than that of the bobbin drive motor M2. As a result, the draw-out roller 54 is turned at the motor speed of the bobbin drive motor M2.

The pulse intervals of a sensor pulse signal outputted from the photo sensor 60 become narrower with time as shown in line (d) of FIG. 6. The effective thread winding amount counting means 61, coupled with the photo sensor 60, counts the number of pulses of the sensor pulse signal within a preset period of time at which reference clock signals are generated, thereby to detect a variation of the sensor pulse signal. A time that the bobbin thread 150 starts to twin round the bobbin shaft 7*a* is detected by detecting a variation of the sensor pulse signal. An amount of the thread accumulatively wound on the bobbin shaft after the thread twines round the bobbin shaft is detected as an effective thread winding amount.

At the instant that the bobbin thread 150 starts to twin round the bobbin shaft 7*a* is detected, the draw-out motor M1 is stopped in operation, and the electromagnetic valve 68 is turned off.

To reduce the time of winding the thread on the bobbin shaft, the speed of the bobbin drive motor M2 is increased to continue the winding operation. If required, there is no need of increasing the motor speed of the bobbin drive motor M2. When a preset number of rotations (a preset thread winding amount) is reached, the bobbin drive motor M2 is stopped.

And the nozzle retracting solenoid 69 is turned on, to thereby retract the air nozzle 67*a* from the opening 8A of the bobbin case 8. In this way, the operation of winding the bobbin thread 150 around the bobbin 7 is automatically performed. Then, the switch SW of the thread tension varying means 204 is turned off, so that the solenoid propelling force is reduced to zero and the thread tension is increased to the maximum. In this state, the bobbin thread 150 that is led from the opening 8A of the bobbin case 8 is automatically hooked to the bobbin case. After the thread hooking operation ends, the switch SW of the thread tension varying means 204 is turned on, so that the solenoid propelling force is increased to the maximum and the thread tension is reduced to the minimum. Then, the thread led from the lower side of the thread tension spring is cut off while leaving a preset amount of the thread.

The thread hooking mechanism for hooking the thread to the bobbin case and the thread cutting mechanism for cutting the thread hooked to the bobbin case may be those described in Published Unexamined Japanese Patent Application No. Hei. 5-192476 and Japanese Patent Application No. Hei. 4-18868. Those mechanisms are not essential to the present invention, and hence no further description thereof will be given here.

After the automatic thread cutting operation is performed, the rotary arm 5 moves back to the retract position on the guide shaft 4 while being turned. Then, it advances while holding the bobbin case 8 containing the bobbin with the thread wound thereon, and loads the bobbin case 8 into the shuttle body 16 at the bobbin case exchanging position A.

As described above, in the bobbin thread winding apparatus of the present embodiment, the draw-out mechanism F draws the bobbin thread 150 out of the thread winder 200. The air guiding means G guides the bobbin thread 150 to the opening 8A of the bobbin case 8. The draw-out mechanism F further draws the bobbin thread 150 from the thread winder 200 at the opening 8A of the bobbin case. The air guiding means G feeds the thread into the bobbin case 8 by the air stream. The bobbin driving means E turns the bobbin, so that the thread reliably twines round the bobbin shaft. Therefore, the thread is confined within the bobbin case 8. Good seams are formed. There is no chance that the bobbin thread will be disconnected. The manual return never happens. Consequently, the reliability of the bobbin thread winding apparatus is improved.

The draw-out motor M1 draws the bobbin thread 150 out of the thread winder 200. The air guiding means G guides the bobbin thread 150 to the opening 8A. The draw-out motor M1 further draws the bobbin thread 150 out of the thread winder 200 at the opening 8A of the bobbin case, with the aid of the draw-out roller 54. The air guiding means G feeds the thread into the bobbin case 8 by the air stream. The bobbin driving means E turns the bobbin, so that the thread reliably twines round the bobbin shaft. At this time, the photo sensor 60 detects a rotation of the draw-out roller 54. The speed is set according to the formula: (The draw-out roller speed)<(The bobbin speed). Therefore, when the bobbin thread 150 gets twisted round the bobbin shaft, the one-way clutch 57 interrupts the transmission of the rotation of the draw-out motor M1 to the draw-out roller 54. The output signal of the photo sensor 60, which has indicated the roller speed of the draw-out roller, is caused to indicate the bobbin speed. The photo sensor detects the twisting of the bobbin thread 150 around the bobbin shaft, and the effective thread winding amount of the thread wound on the bobbin shaft. The effective thread winding amount is set to be the amount of the thread that is wound on the bobbin shaft after the thread gets twisted round the bobbin shaft. And it depends on the rotation of the draw-out roller 54, not the rotation of the bobbin. Therefore, it is possible to accurately grasp the effective thread winding amount irrespective of the yarn count. Further, when the thread is wound, the one-way clutch 57 blocks the application of the load of the draw-out motor M1 to the bobbin driving means E. Therefore, it does not affect any adverse influence to the stitching quality, thereby improving the reliability.

The thread guide of the tip of the air nozzle 67*a* is directed to the bobbin-shaft thread winding side X. With this thread guide direction, the bobbin thread 150 fed into the bobbin case 8 is securely twisted round the bobbin shaft 7*a*.

It is intended that the effective thread winding amount is set to be the amount of the thread that is wound on the bobbin shaft after the thread gets twisted round the bobbin shaft. The effective thread winding amount is accurately grasped. The draw-out mechanism F and the air guiding means G are not essential. The thread may manually be inserted into the bobbin case 8 in a manner that the thread is pulled out of the thread winder 200 as a thread supply source and the tip of the thread is inserted into the bobbin case 8 through its opening 8A.

With regard to the control of the bobbin thread winding apparatus, means for detecting the number of revolutions of the bobbin 7 may be used in addition to the means to detect the twining of the thread 150 to the bobbin shaft on the basis of the output signal of the photo sensor 60. Such a means may be an encoder. In operation, after the twining of the bobbin thread 150 to the bobbin shaft is detected, the bobbin revolution detecting means starts to detect the amount of the thread wound on the bobbin 7.

While the present invention has been described in details using its preferred embodiment, it is apparent that the present invention is not limited to the above-mentioned embodiment but may variously be changed, modified and altered within the scope of the present invention. In the embodiment described above, the air nozzle 67*a* (driven by the nozzle retracting solenoid 69) is retracted from the opening BA of the bobbin case 8 in order to avoid their interference at the time of hooking and cutting the thread. Other suitable means than the nozzle retracting solenoid 69 may be used for the same purpose, as a matter of course.

In a modification of the embodiment mentioned above, a determining means for determining an amount of the thread supplied from a thread supply source on the basis of the effective thread winding amount may be additionally provided. An abnormal supply of the thread 150 from the thread supply source is detected by the determining means. Examples of the abnormal supply of the thread are a case where the bobbin thread 150 is used up and a case where the bobbin thread 150 gets entangled.

The output shaft 56 of the draw-out motor M1 may directly be coupled with the draw-out roller shaft 55 by means of a coupling, for example, not the one-way clutch 57. In this case, it is desirable to set the speed of the draw-out roller shaft 55 to be substantially equal to or somewhat higher than the speed of the bobbin. Further, when the thread twines round the bobbin shaft, the draw-out motor M1 must be stopped. The time of stopping the draw-out motor M1 is empirically determined. Further, in this case, the detection of the roller speed of the draw-out roller 54 starts from a time that the draw-out motor M1 stops its operation. There is a rare chance that the motor stop time is exactly coincident with the time of the twining of the thread round the bobbin shaft (since an actual thread twining time is unknown), as described above. As a result, the effective thread winding amount is not exact. Further, at the time of winding the thread, the load of the draw-out motor M1 when it is not energized is applied to the bobbin drive motor M2. The stitching quality may be slightly adversely affected.

The second preferred embodiment of the present invention will be described with reference to the accompanying drawings.

Figure 33:
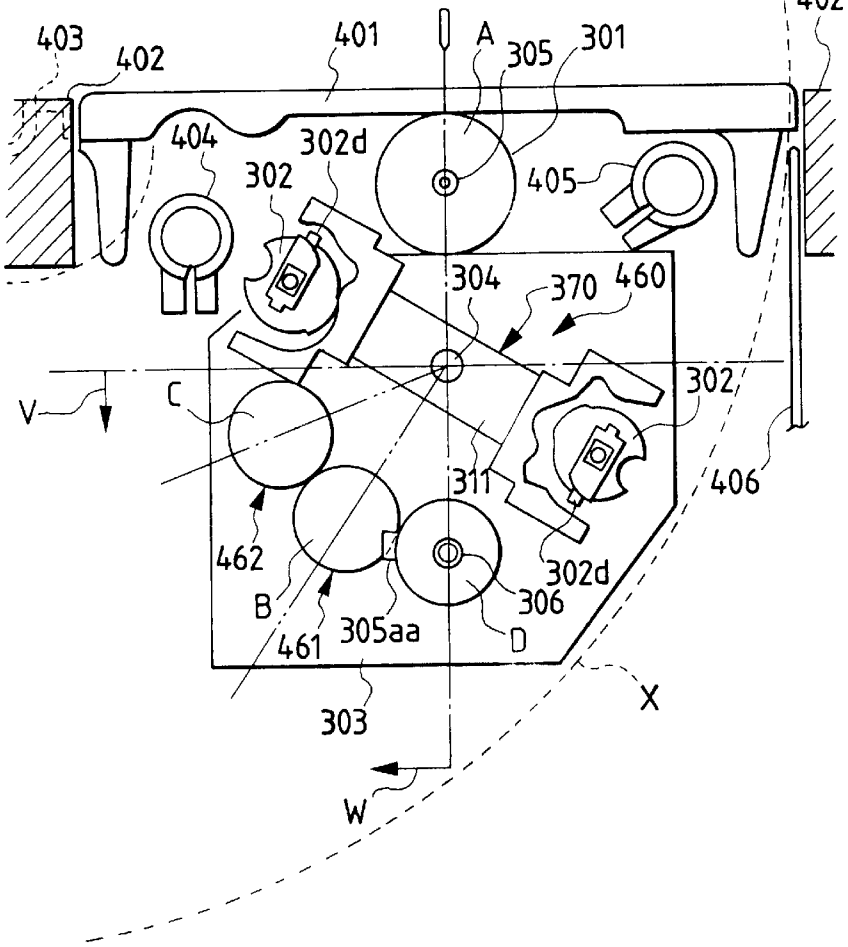
FIG. 33 is a front view showing an automatic bobbin thread supplying apparatus incorporating the bobbin thread winding apparatus thereinto.

An automatic bobbin thread supplying apparatus according to a preferred embodiment of the present invention, as shown in FIG. 33, is made up of a bobbin thread winding apparatus 462, a residual thread removing apparatus 461, a bobbin exchanging apparatus 460. The bobbin exchanging apparatus 460 is able to move a bobbin case 302 to any of a bobbin thread winding position C of the bobbin thread winding apparatus 462, a residual thread removing position B of the residual thread removing apparatus 461, a shuttle position (bobbin case exchanging position) A, and a bobbin case set/removal position D of a dummy shaft (bobbin case holder means) 306. The automatic bobbin thread supplying apparatus is located under a sewing machine bed 401. The bobbin exchanging apparatus 460 will first be described with reference to FIGS. 34 to 38. In FIGS. 34 through 38, reference numeral 301 designates a shuttle body which receives the bobbin case 302; 301*a*, a shuttle shaft; 303, a base plate as a support member which is located under the shuttle body 301 and stands upright on a main base mounted on a sewing machine body proper. The fixed end 304*a* of a transferring shaft 304, arrayed in parallel with the shuttle shaft 301*a*, is fastened to the base plate 303 and supported by the base plate in a cantilever fashion.

A transferring block 312 (FIG. 34), cylindrical in shape, is rotatably and slidably mounted on a part of the transferring shaft 304 that is closer to the open end 304*b* (FIGS. 35 and 37) of the transferring shaft (located in opposition to the base plate). Two parts on the outer surface of a cylindrical transferring block are cut in the axial direction in a state that the cut faces of these cut parts are arranged facing each other.

Figure 34:
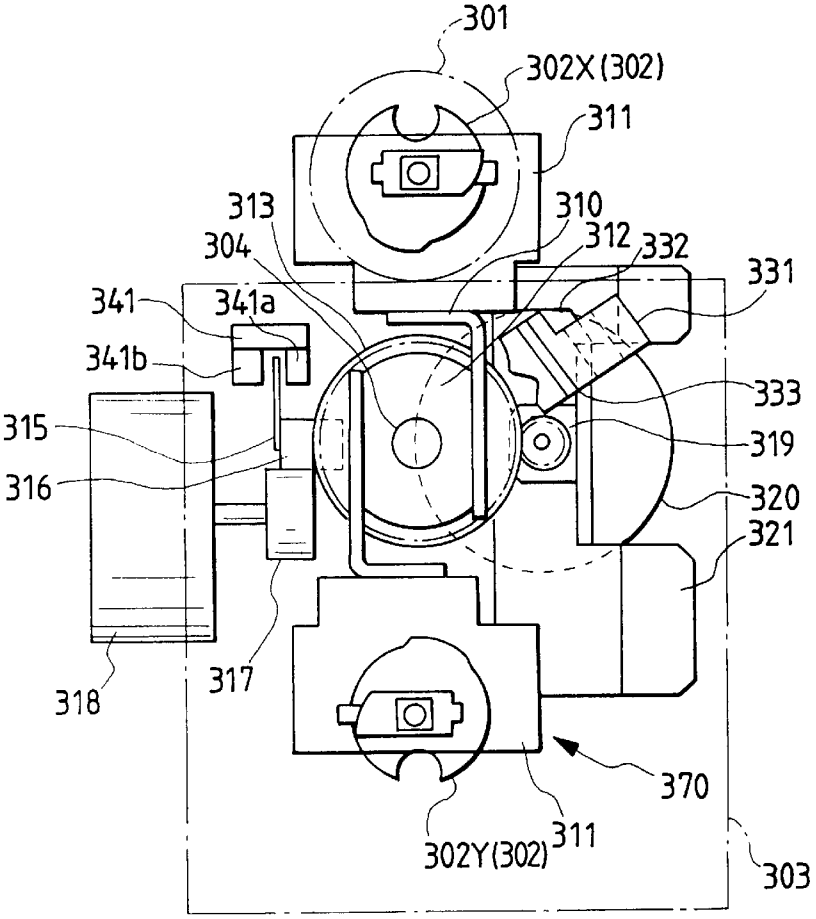
FIG. 34 is a front view showing a bobbin exchanging apparatus used in the automatic bobbin thread supplying apparatus.

A pair of L-shaped transferring plates 310 and 310 are provided. The first legs of the L-shaped transferring plates 310 and 310 are respectively fastened to the cut faces of the cut parts of the transferring block, and the second legs thereof are oppositely arranged with respect to the axial line, as shown in FIG. 34.

A pair of holding sections 311 and 311 are bent to the shuttle in the axial direction. The first ends of the holding sections 311 and 311 are firmly attached to the L-shaped transferring plates 310 and 310, respectively. Bobbin case holding means (not shown), which hold the bobbin case and release the hold of the bobbin case, are respectively fastened to the second ends of the holding sections 311 and 311 (which are directed to the shuttle). The bobbin case holding means may be a pair of electromagnetic attracting heads used in an automatic bobbin thread supplying apparatus disclosed in Japanese Patent Application No. Hei. 5-192476 or Japanese Patent Application No. Hei. 5-121960 filed by the applicant of the present Patent Application, or the lever pawls used in an automatic bobbin thread supplying apparatus disclosed in Japanese Patent Application No. Hei.

5-116363, filed by the same applicant. Any other means may be used if it is capable of attaching the bobbin case 302 to an opposite member (e.g., the shuttle body) and removing the same therefrom.

Figure 35:
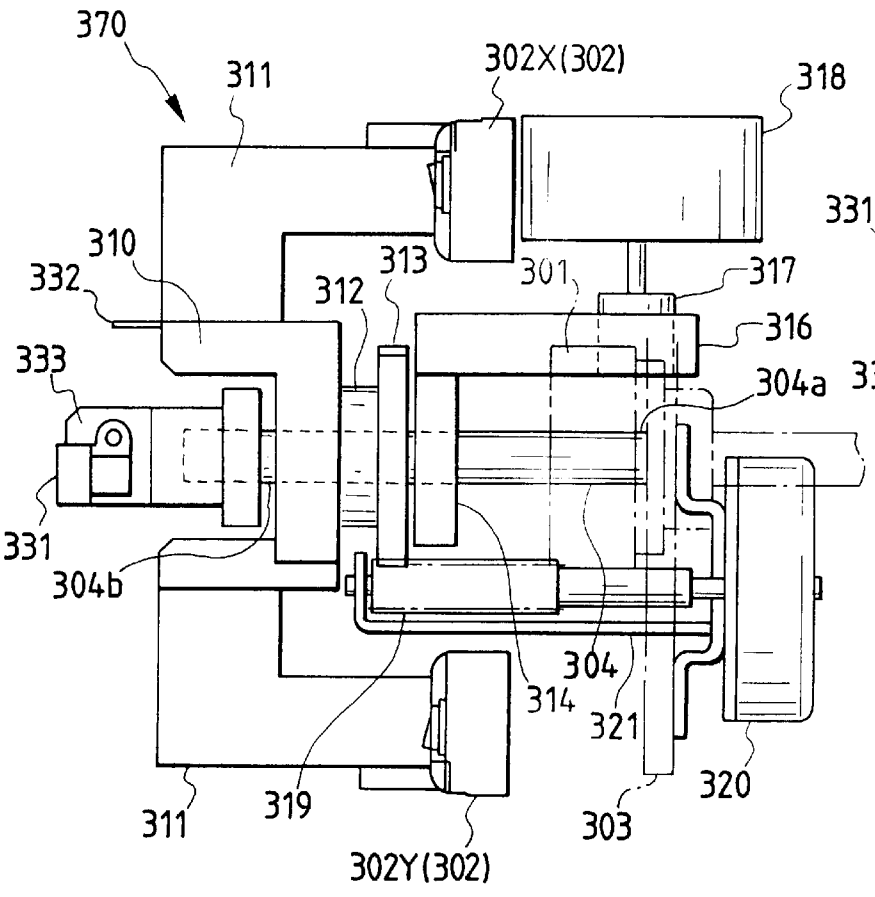
FIG. 35 is a plan view showing the bobbin exchanging apparatus.

A gear 313 is firmly fixed to the outer surface of the transferring block 312. The gear 313 is in mesh with a driving gear 319 elongated along the shuttle shaft 301*a* as shown in FIG. 35. One end of the driving gear 319 is rotatably supported by a portion protruded to the second end of the transferring shaft of a motor mounting plate 321 mounted on the base plate 303. The other end of the driving gear is directly coupled with the output shaft of a rotation motor 320 fastened to the motor mounting plate 321.

A rotary arm 370 is formed of the transferring block 312, the L-shaped transferring plates 310 and 310, and the holding sections 311 and 311. When the rotation motor 320 is turned, the rotary arm 370 is turned. The rotary arm 370 is operated when it is at the retract position (FIGS. 35 to 37) in the present embodiment. The transferring shaft 304, which is supported in a cantilever fashion, is guided by the driving gear 319. Therefore, its support strength is sufficiently high.

A stop spring, not shown, is fixedly mounted at a location on the outer surface of the transferring block 312, which is closer to the fixing end of the transferring shaft 304 than the gear 313. A movable collar 314 is rotatably supported between the gear 313 and the stop spring on the outer surface of the transferring block 312.

Figure 36:
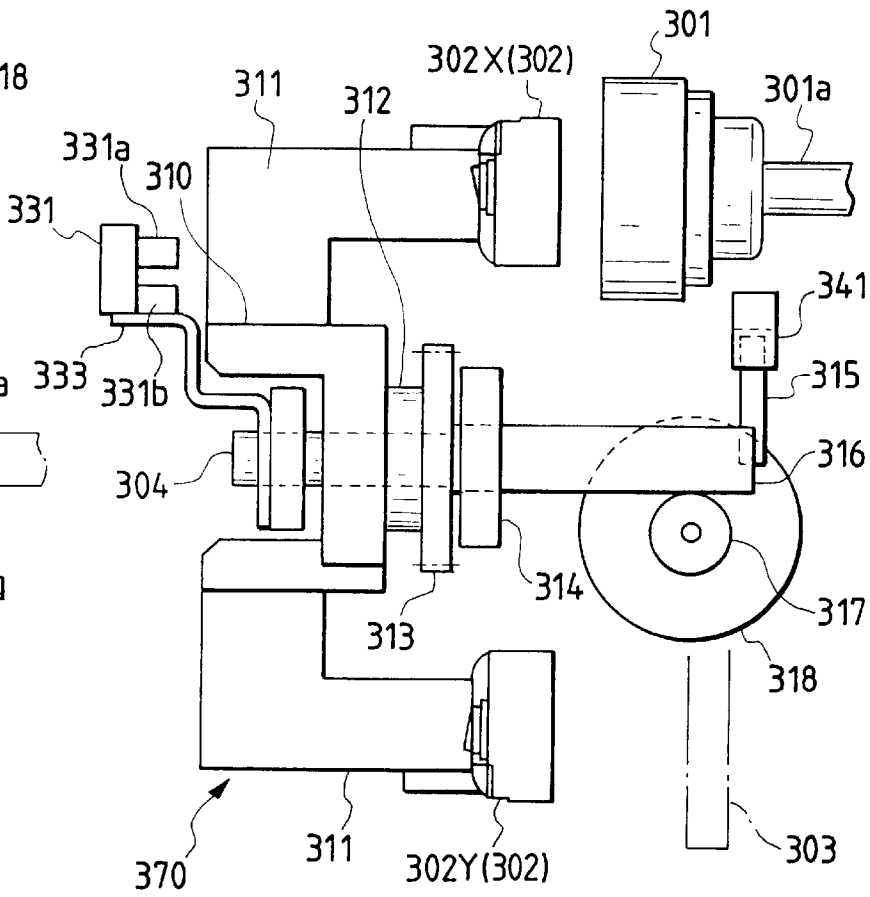
FIG. 36 is a left side view showing the bobbin exchanging apparatus.

One end of a rack 316, which is movable in parallel with the shuttle shaft 301*a*, is secured to the movable collar 314, as shown in FIGS. 34 to 36. The other end of the rack 316 is in mesh with a pinion 317. The pinion 317 is firmly fixed to the output shaft of a movement motor 318 mounted on the base plate 303.

When the movement motor 318 is driven, the movable collar 314 and the rotary arm 370, together with the rack 316, are moved in the axial direction of the transferring shaft 304, with the aid of the pinion 317. Thus, the rotary arm 370 is rotatable and movable about and along the transferring shaft 304.

A detector mounting plate 333 is mounted on the open end of the transferring shaft 304. A rotation sensor 331 including a light emitting element 331*a* and a light receiving element 331*b* is mounted on the detector mounting plate 333. A detection plate 332 is firmly fixed to the rotary arm 370, as shown in FIGS. 34 and 35. The rotation sensor 331, the detector mounting plate 333, and the detection plate 332 are adjusted in their positions such that when the rotary arm 370 is turned, the detection plate 332 passes between the light emitting element 331*a* and the light receiving element 331*b*.

A movement detector 341, which has the same construction as of the rotation sensor 331, is mounted on the base plate 303 as shown in FIGS. 34 and 36. A sensor plate 315 is firmly fixed to the rack 316. The movement detector 341 and the sensor plate 315 are adjusted in their positions such that when the rotary arm 370 is moved, the sensor plate 315 passes between a light emitting element 341*a* and a light receiving element 341*b*.

Figure 38:
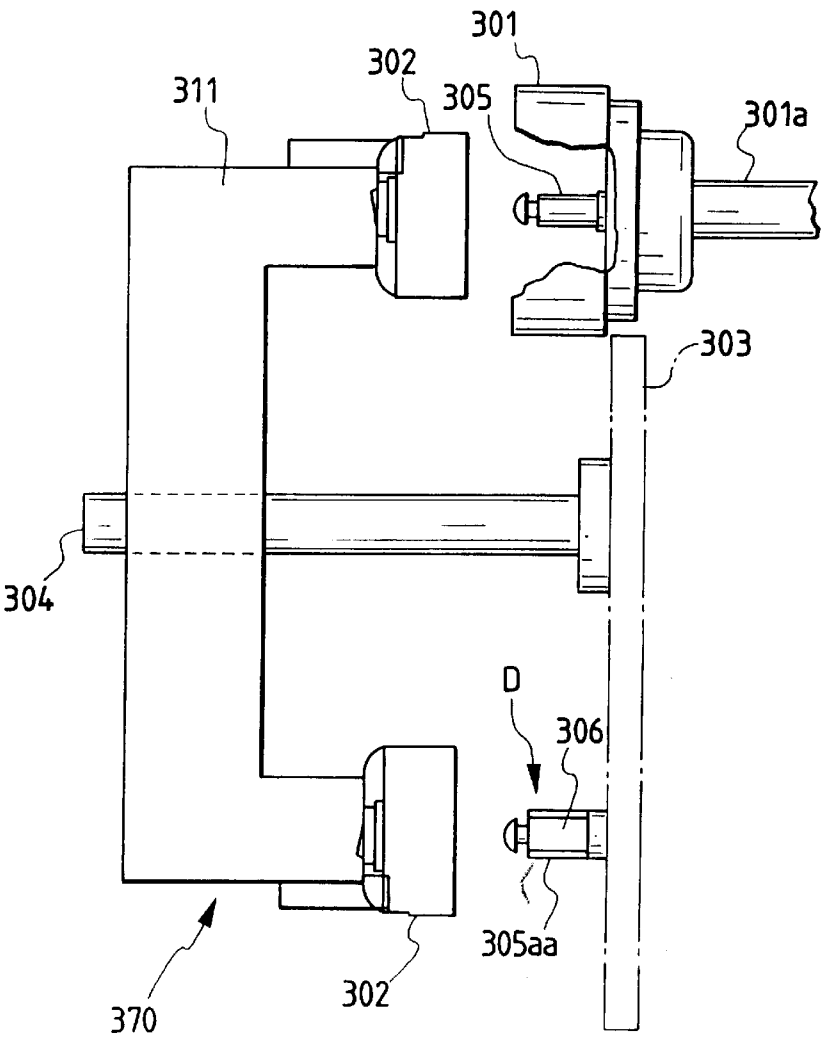
FIG. 38 is a side view for explaining a dummy position and a dummy shaft.
Figure 37:
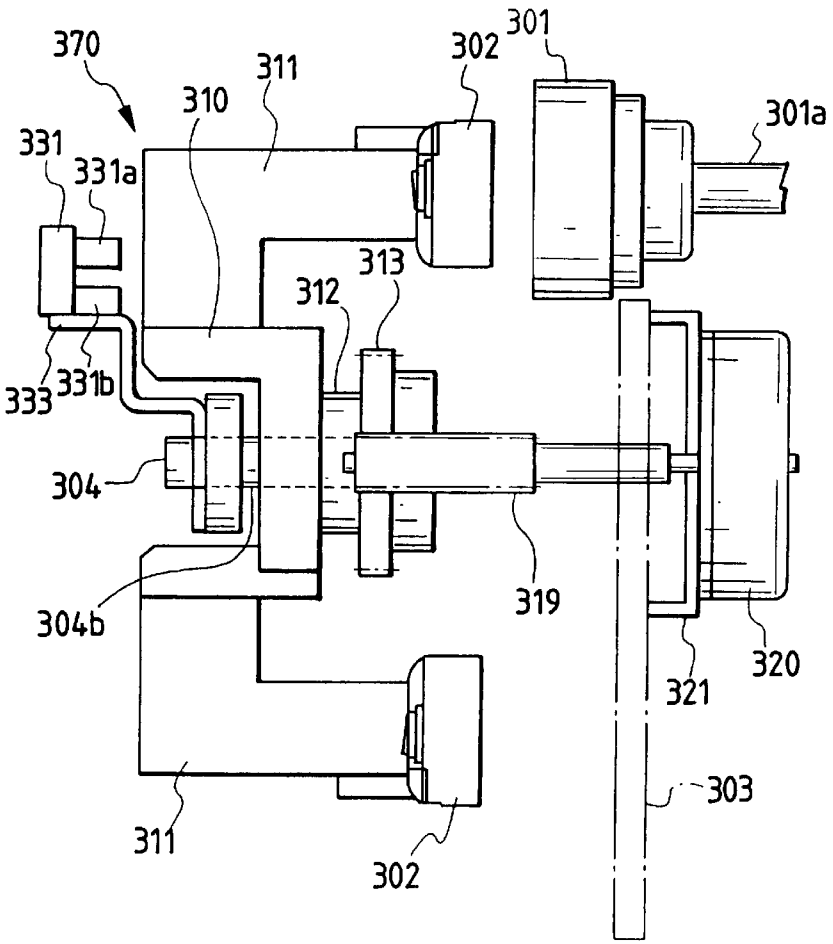
FIG. 37 is a right side view showing the bobbin exchanging apparatus.

A dummy shaft 306 as the bobbin case holding means is firmly fixed to the position D right under the shuttle body 301 as shown in FIG. 33. The position D is a position on the base plate 303 which faces a locus of the rotating bobbin case holding means. The dummy shaft 306 has the same construction as of a shuttle shaft 305, as shown in FIG. 38. When the bobbin case 302 containing the bobbin is pushed to the shaft, it can hold the bobbin case 302. When the bobbin case 302 is pushed to the shaft, a bobbin locking pawl 302*d* of the bobbin case 302 is put into the groove of a rotation locking member 305*aa* protruded in the vicinity of the dummy shaft 306, as shown in FIG. 33. Thus, the bobbin case 302 is positioned at a preset position and held thereat.

The bobbin thread winding position C and the residual thread removing position B are located facing the locus of the rotating bobbin case holding means in an area V below the transferring shaft 304 and an area W containing a pivot 403 about which the sewing machine bed 401 is turned when it is raised from a vertical plane along the transferring shaft 304 (FIG. 33). The residual thread removing position B is lower than the bobbin thread winding position C. The residual thread removing position B is located at a retract position of the bobbin case holding means when viewed in the axial direction of the transferring shaft (in the direction vertical to the paper surface of FIG. 33). The bobbin thread winding position C is located at a position reached when the bobbin case holding means is slightly moved forward from the retract position along the axis of the transferring shaft (moved toward the paper surface of FIG. 33).

A residual thread removing apparatus 461 is disposed at the residual thread removing position B. In the present embodiment, the residual thread removing apparatus 461 is a means which has a clamping member which is able to clamp the tip of a thread wound on the bobbin and to release the clamp of the thread, and is turned about an axis when it is driven by a motor, for example, whereby the bobbin thread clamped with the clamping member is automatically wound. However, the residual thread removing apparatus 461 may be any other means if it functions such that in a state that the bobbin case 302 is held by the bobbin case holding means, or that the bobbin case 302 is transferred to a means capable of holding the bobbin case and it is held by the means, when a thread draw-out means for drawing out a thread that is wound on a bobbin and led (hung down) from the bobbin case containing the bobbin is operated for drawing the thread out of the bobbin case, the bobbin is turned to allow the thread to be drawn out therefrom. A specific example of the residual thread removing apparatus 461 is a residual bobbin-thread removing apparatus disclosed in Japanese Patent Application No. Hei. 5-203610 or 6-40351.

As described above, the residual thread removing apparatus is constructed so as to draw out a thread that is wound on the bobbin and hung down from the bobbin case containing that bobbin, from the bobbin case. Since the residual thread removing apparatus has such a basic construction, its major portion is located lower than the residual thread removing position B.

The bobbin thread winding apparatus 462 is disposed at the residual thread removing position B. The bobbin thread winding apparatus 462 is capable of automatically winding a bobbin or lower thread on a bobbin with the turn of a motor, for example, and then hooking the thread to the bobbin case 302 and cutting the thread. The bobbin thread winding apparatus 462 with such functions will be described hereinafter.

Figure 14:
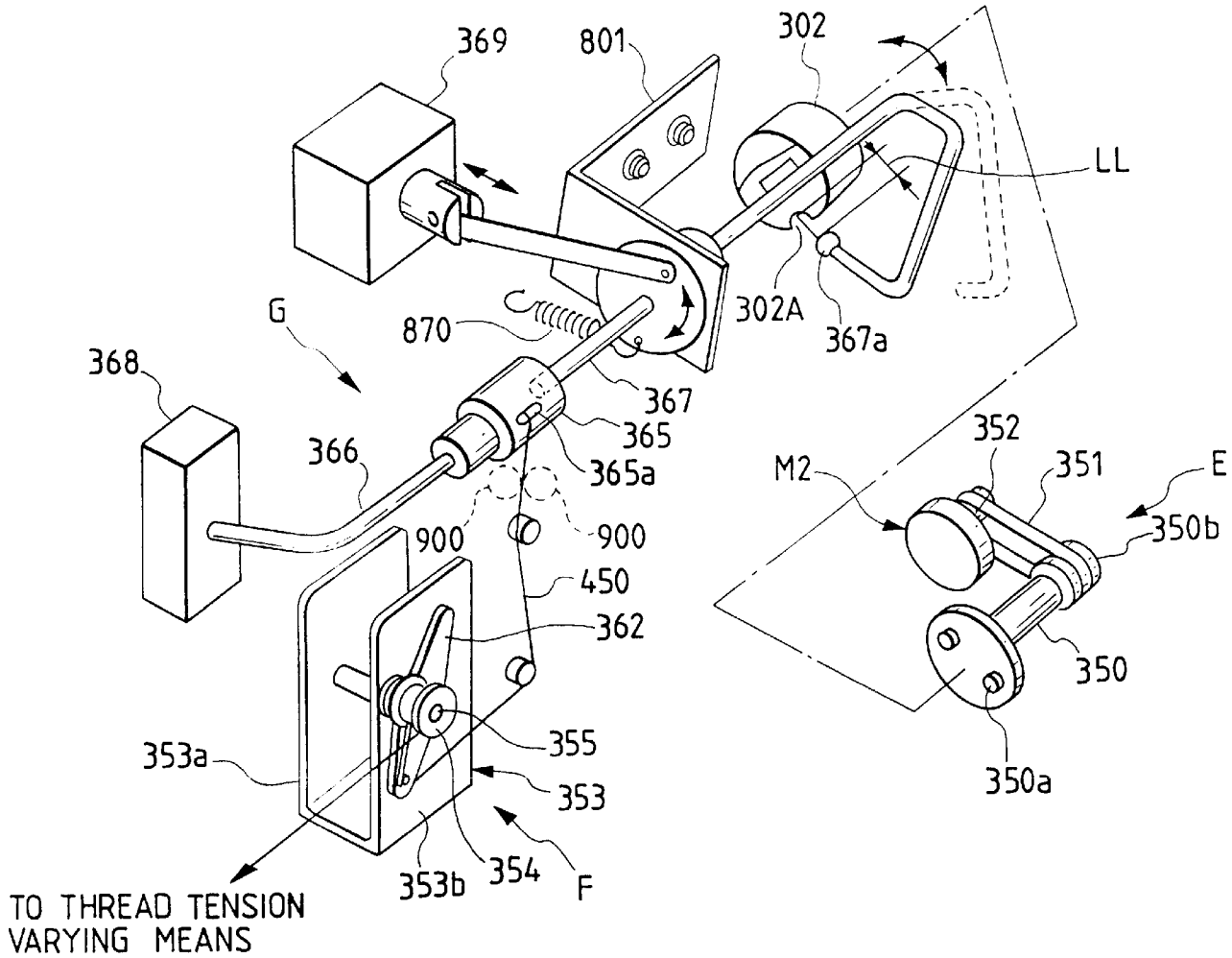
FIG. 14 is a perspective view showing another bobbin thread winding apparatus of the present invention.
Figure 15:
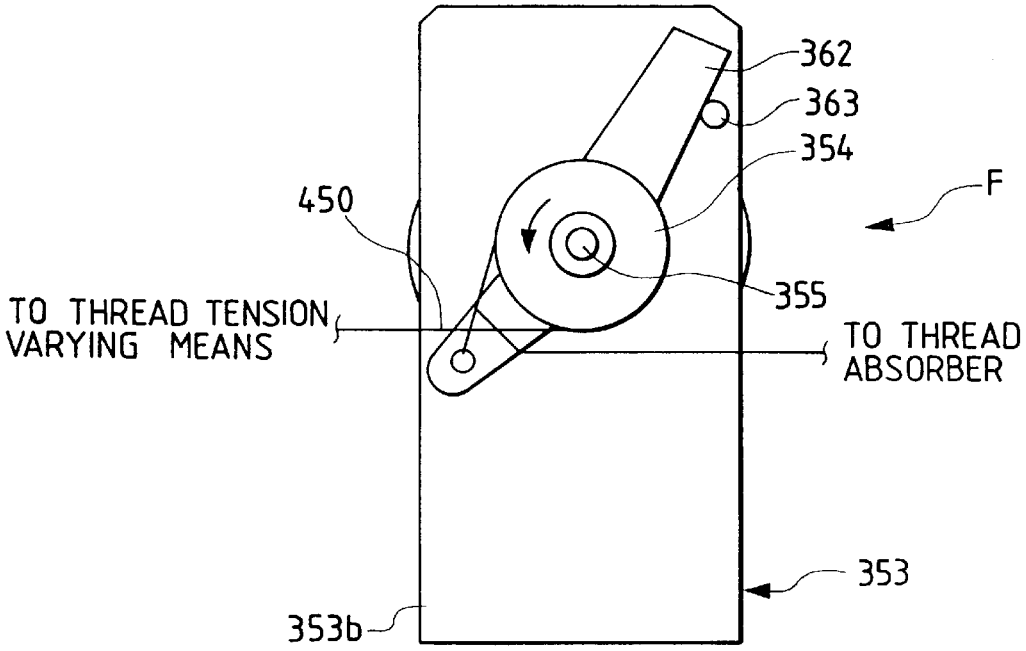
FIG. 15 is a front view showing a mechanism for detecting the thread getting entangled and the amount of winding thread, and a looseness correcting mechanism.
Figure 16:
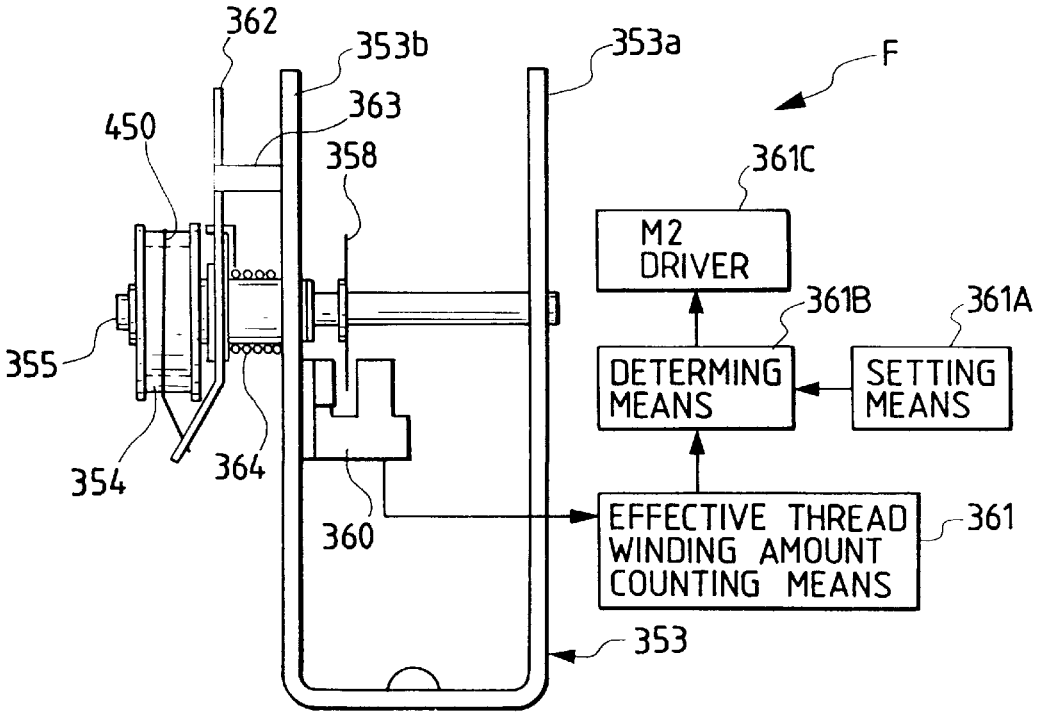
FIG. 16 is a view showing in schematic and block from the mechanism of FIG. 15.

The bobbin thread winding apparatus is provided with a bobbin driving mechanism E as a bobbin driving means for turning the bobbin. The bobbin driving mechanism E follows. In FIG. 14, reference numeral 350 designates a winding shaft. The winding shaft 350 is rotatably supported by a base, not shown. A clutch mechanism 350*a* is fastened to one end of the winding shaft 350. The clutch mechanism 350*a* is provided at one end of the winding shaft 350. The clutch mechanism 350*a* engages or disengages with or from a plural number of holes already formed in the bobbin 307. A pulley 350*b* is fixed securely to the other end of the winding shaft 350. A bobbin drive motor M2 is also fastened to the base. A pulley 352 is firmly attached to the output shaft of the bobbin drive motor M2. A belt 351 is stretched between the pulleys 352 and 350*b*.

The rotary arm 370 is turned and the bobbin case 302 is moved to and reaches the bobbin thread winding position C. Then, the rotary arm 370 advances and the bobbin case 302 also advances. The bobbin drive motor M2 is driven to turn, so that the clutch mechanism 350*a* is coupled with bobbin 307. The clutch mechanism used is constructed so as to engage or disengage with or from the holes. It is evident that the clutch mechanism m ay take any suitable construction other than the above one.

The bobbin thread winding apparatus is provided with a mechanism for correcting a looseness of a bobbin thread 450 out of a thread winder 500 acting as a thread supply source (FIG. 17), and a mechanism for detecting the twisting of the thread round the bobbin shaft and the amount of the thread wound around the bobbin (these mechanisms are generally denoted as F). The mechanism F follows. Reference numeral 353 designates a base in FIGS. 14 to 17. The base 353 is shaped like a U in cross section. A roller shaft 355 is rotatably supported between both the side plates 353*a* and 353*b* of the base 353. The roller shaft 355 is extended outside the side plate 353*b* of the base. A roller 354 is fastened to the part of the roller shaft 355 extended outside the side plate 353*b*. The bobbin thread 450 drawn out of the thread winder 500 is wound (by one turn) around the extended part of the roller shaft 355.

A sensor slit 358 is fastened to a part of the roller shaft 355 located between the side plates 353*a* and 353*b*. The sensor slit 358 is shaped like a disc. A groove is formed in the circumferential part of the disc-like sensor slit 358. A photo sensor 360 is disposed at a location facing the sensor slit 358. The photo sensor 360 detects the groove of the sensor slit 358. In other words, the photo sensor 360 senses a rotation of the draw-out roller 354.

The photo sensor 360 is coupled with an effective thread winding amount counting means 361, which detects the twine round the bobbin shaft and also detects the effective amount of the thread wound around the bobbin shaft. A determining means 361B is connected to the effective thread winding amount counting means 361. The determining means 361B compares a preset thread winding amount from a setting means 361A, located outside, for setting a preset thread winding amount, with an amount of thread actually wound around the bobbin that is outputted from the effective thread winding amount counting means 361. When both the thread winding amounts are coincident in value with each other, the determining means 361B produces a drive stop signal to a motor driver 361C.

A looseness correcting mechanism for correcting a looseness of the bobbin thread 450 is additionally provided in the mechanism F. The looseness correcting mechanism includes a looseness correcting lever 362, a spring 364, and a stopper 363. The looseness correcting lever 362 is rotatably supported by the draw-out roller shaft 355 with a bearing (not shown) intervening therebetween. The bobbin thread 450 passes through looseness correcting lever 362. The spring 364 urges the looseness correcting lever 362 so as to remove a looseness of the bobbin thread 450. The stopper 363 stops the turn of the looseness correcting lever 362, which is caused by the urging force by the spring 364.

An air guiding means G is provided downstream of the mechanism F. The air guiding means G (also serves as a thread twisting means (air means) in the present embodiment) guides the bobbin thread 450, which is pulled out by the draw-out mechanism F, to an opening 302A of the bobbin case 302. The air guiding means G follows. In FIG. 14, reference numeral 365 designates a thread absorber 365 shaped like a tube. An absorbing hole 365*a* is formed in the thread absorber 365, as shown in FIGS. 14 and 18. The absorbing hole 365*a*, which connects to exterior, is directed in the higher part of the string flow. One end of an air tube 366, which communicates with the inner space of the thread absorber 365, is coupled with the upstream part of the thread absorber 365. The other end of the air tube 366 is connected to an electromagnetic valve 368, which is connected to an air source, not shown. A thread applying switch, not shown, is provided, which is used for turning on and off the electromagnetic valve 368.

Figure 21:
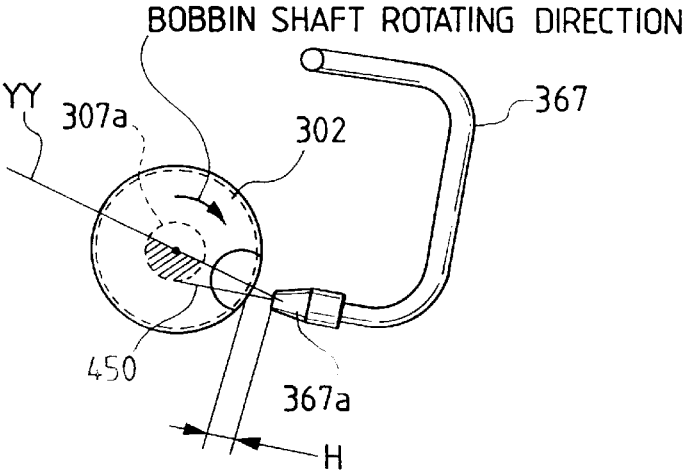
FIG. 21 shows the position of the tip of an air guide means also serving as an air means to the bobbin case and the bobbin shaft when the machine operates to twine the thread round bobbin shaft.
Figure 22:
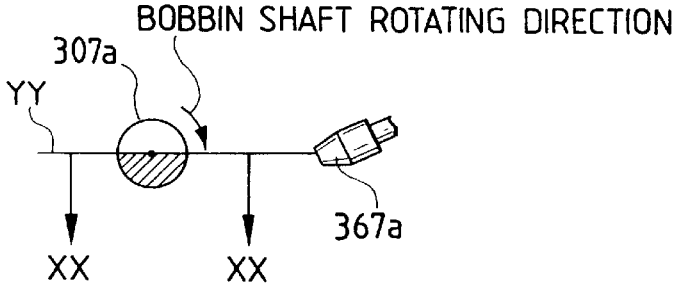
FIG. 22 is a view for explaining the thread-winding side of the bobbin shaft.

One end of an air tube 367, which communicates with the inner space of the thread absorber 365, is connected to the downstream part of the thread absorber 365, and rotatable about the thread absorber 365. The other end part of the air tube 367 is bent to have a shape of U. The air tube 367 is disposed so that an air nozzle 367*a* at the other end thereof faces the opening 308A of the bobbin case 302 in a state that the clutch mechanism 350*a* is coupled with the bobbin 307. As shown in FIGS. 21 and 22, the thread guide direction (air blowing direction) of the tip of the air nozzle 367*a* (the tip of thread inserting means; the tip of the air guiding means) when it stops at the position (referred to as a facing position) where it faces the opening 308A of the bobbin case 308 (viz., it is located at the work position) lies on the thread-winding side of the bobbin shaft.

The "thread-winding side of the bobbin shaft" indicates one side of the bobbin shaft segmented by a line YY that is prolonged from the tip of the air nozzle 367*a*, while passing through the center of the bobbin shaft, viz., the side (indicated by arrows XX) of the bobbin shaft 307*a* which receives the bobbin thread 450 (FIG. 22). The thread guide direction of the tip of the air nozzle 367*a* is preferably the direction in which a line prolonged from the tip of the air nozzle 367*a* intersects the circumference of the bobbin shaft 307*a* on the bobbin-shaft thread winding side XX, more preferably the direction in which a line prolonged from the tip of the air nozzle 367*a* touches a point on the circumference of the bobbin shaft 307*a*.

A length (LL) (FIG. 14) of the thread led from the air nozzle 367*a* is selected to such an extent so as to twine the lead thread round the bobbin shaft. Such a length (referred to as a necessary length) of the lead thread is preferably (1) {(the distance between the air nozzle located at the work position and the outer surface of the bobbin shaft)+[length of the circumference of the bobbin shaft×(1.1~2.0)]}, or more preferably (2) {(the distance between the air nozzle located at the work position and the outer surface of the bobbin shaft)+[length of the circumference of the bobbin shaft×(1.25~1.8)]}.

If the necessary length of the lead thread is longer than the length (1) above, it is difficult to introduce the end of the lead thread into the bobbin case 302 through the opening 302A thereof. If it is successfully introduced into the bobbin case 302, the thread is possibly wound around the bobbin shaft more than one turn to make a knot by itself and to tighten the bobbin shaft 307*a*. If the necessary length of the lead thread is shorter than the length (1) or (2), there is a chance that the end of the lead thread fails to get twisted round the bobbin shaft.

In the present embodiment, the necessary length of the lead thread is selected to be 55 mm. This figure is derived from the following dimensions: a distance between the tip of the air nozzle 367*a* and the opening 302A of the bobbin case 302 is 7 mm, a distance between the opening 302A of the bobbin case and a point on the outer surface of the bobbin shaft where the lead thread touches the outer surface thereof, and (25 mm (circumference of the bobbin shaft)×1.64)=31 mm.

When the electromagnetic valve 368 is turned on, air is supplied from the air source, travels through the air tube 366, the thread absorber 365, and the air tube 367, and is blown out of the air nozzle 367*a*. The end of the lead thread that is led into the absorbing hole 365*a* of the thread absorber 65 is derived from the air nozzle 367*a*.

A distance LL between the top of the air nozzle 367*a* which stops at the facing position and the opening 302A of the bobbin case 302 (FIG. 14) is preferably 10 mm or less, more preferably 3 to 7 mm. If the distance is selected to be within this range, the bobbin thread 450 is flapped by the air blown out, an eddy current necessary for the bobbin thread 450 to twine round the bobbin shaft 307*a* within the bobbin case 308 is formed.

A mid part of the air tube 367 is rotatably supported by the sewing machine bed 801 of the bobbin thread winding apparatus. The air tube 367 is urged clockwise (FIG. 14) by a spring 870, which constitutes one of moving means. When it is driven by a nozzle retracting solenoid 369 which constitutes the other of the moving means, it is turned resisting the urging force of the spring 870. In the present embodiment, a latching solenoid is used for the nozzle retracting solenoid 369. When an ON signal is applied to the nozzle retracting solenoid 369 (line (c) of FIG. 19), the air nozzle 367*a* retracts from the opening 302A of the bobbin case 302 while resisting the urging force of the spring 870. When an OFF signal is applied to the nozzle retracting solenoid 369 (line (d) of FIG. 19), the air nozzle 67*a* is moved to the facing position where it faces the opening 302A of the bobbin case 302, by the urging force of the spring 870.

Figure 23:
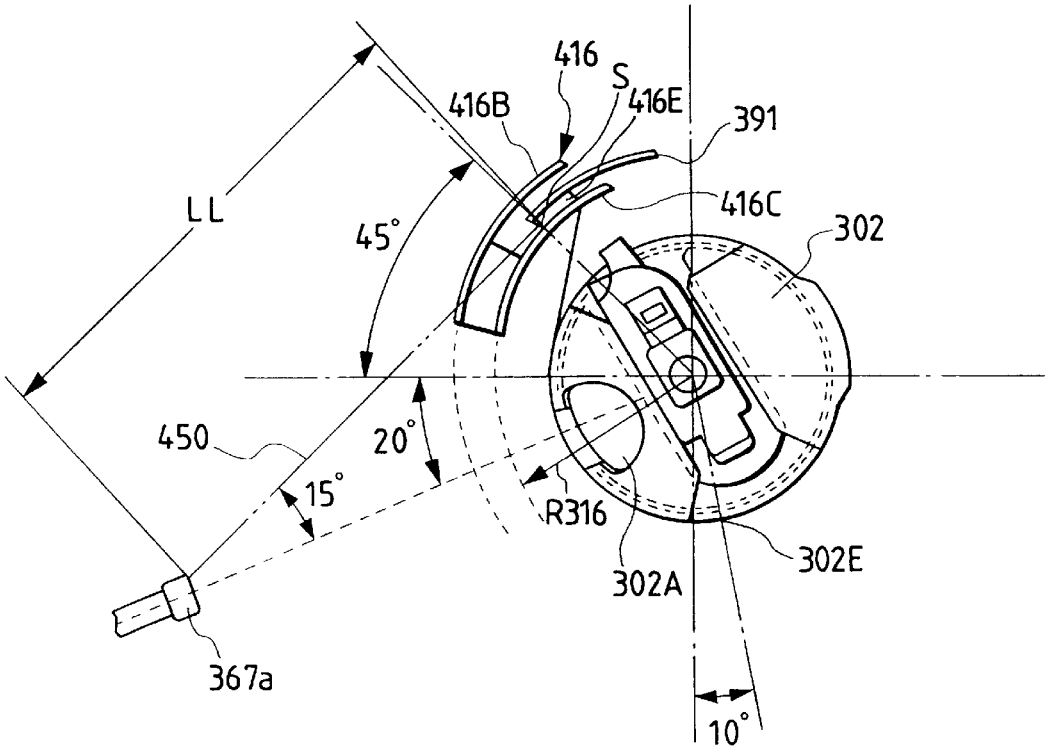
FIG. 23 shows the position of the tip of an air guide means also serving as an air means to the cutting means and the bobbin case when the machine operates to cut the thread.

A thread handing member 416 with a movable blade, which constitutes thread hooking means and thread cutting means, is fixedly disposed in the vicinity of the bobbin case 302 when the bobbin case 302 is set at the bobbin thread winding position C (FIG. 23).

Figure 24:
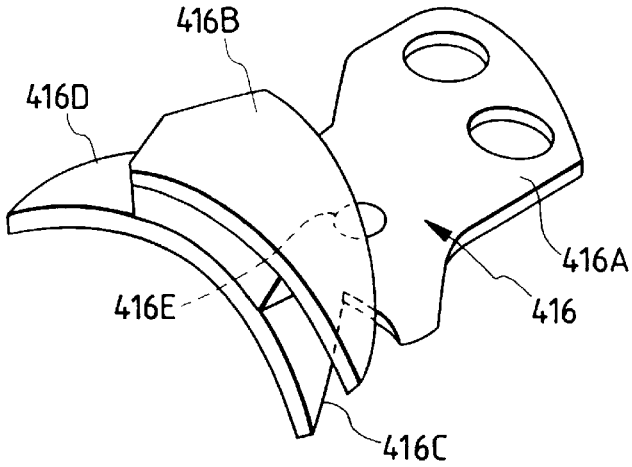
FIG. 24 is a perspective view showing a thread handing member with a movable blade, which is attached to the bobbin thread winding apparatus.
Figure 29:
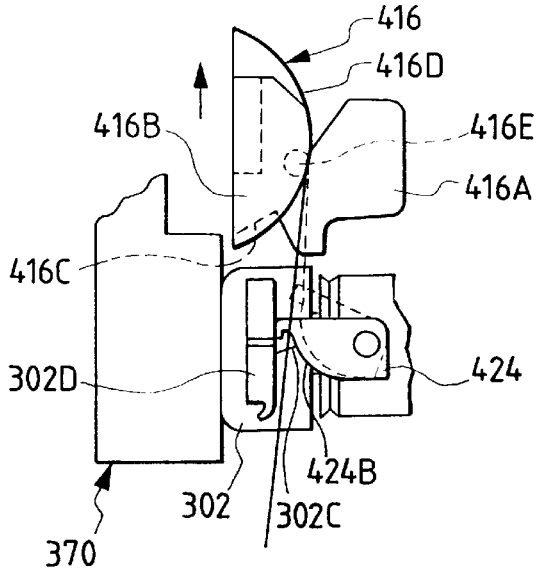
FIG. 29 is a plan view showing a key portion of the bobbin thread winding apparatus when a bobbin thread is guided to the slit of the bobbin shaft.
Figure 32:
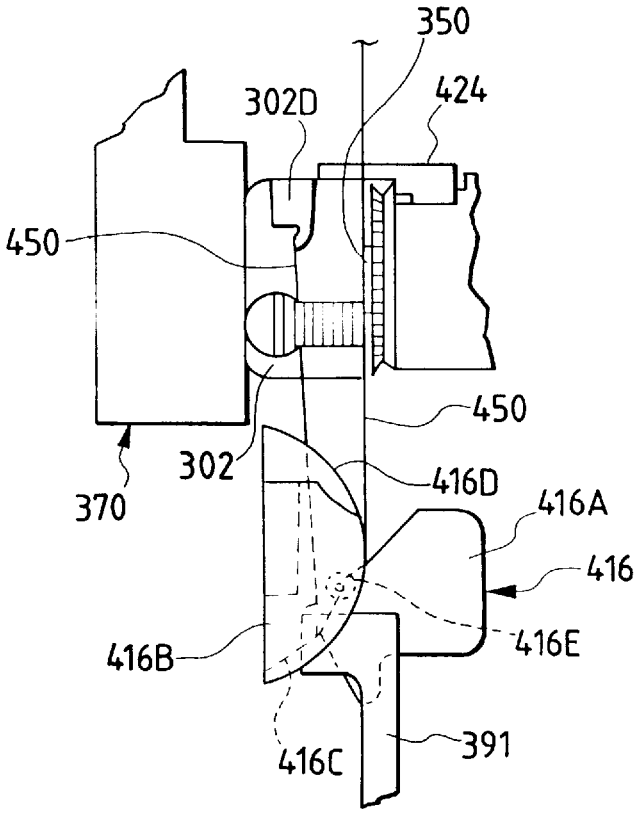
FIG. 32 is a side view showing a key portion of the bobbin thread winding apparatus when the thread is cut.

The thread handing member 416 is provided with a movable blade 416A (FIG. 24). The movable blade 116A includes cutting portion 416C and 416D, shaped like a V. The cutting portions 416C and 416D guide the thread into the leading end (the fore side in FIG. 24) and the rear end (the deeper side in FIG. 24). The vertex of the V-shaped cutting portion 416C is shifted to the left with respect to the vertex of the V-shaped cutting portion 416D in FIG. 24 (FIGS. 29 and 32). A cutting eye ball (movable blade) 416E is provided on a line roughly connecting the vertices of the cutting portions 416C and 416D on the upper surface of the movable blade 416A. A small space is provided above the cutting eye ball 416E. The small space allows a stationary blade 391 to pass therethrough. A thread separating piece 416B is also provided above the cutting eye ball 416E in a state that the edge of the thread separating piece 416B is slightly shifted from the cutting eye ball (FIGS. 23 and 32). The movable blade 416A and the thread separating piece 416B are coaxially arcuate centered at the winding shaft 350 (FIGS. 23 and 24). When the thread handing member 416 is turned around the bobbin case 302 and reaches the position of the stationary blade 391, the cutting eye ball 416E on the rear side of the movable blade 416A slides on the tip of the stationary blade 391. Those related components are disposed so.

A reversible motor, not shown, turns the thread handing member 416 through a chain of gears, not shown. Thus, the thread handing member 416 is turned in the forward or the reverse direction by the reversible motor.

Figure 27:
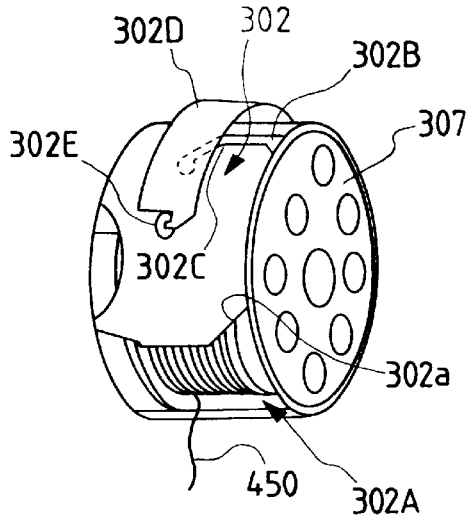
FIG. 27 is a perspective view showing a bobbin case used in the second embodiment.

The bobbin case 302, the stationary blade 391, a thread cutting point S, and the like are disposed such that a length of the thread from a thread lead hole 302E to the thread cutting point S (more exactly, a point where the cutting eye ball 416E is brought into contact with the stationary blade 391) is equal to a length of the thread necessary for forming a seam by the intertwining of the thread, i.e., approximately 40 mm (FIG. 23). The thread lead hole 302E is located under a tension spring 302D (FIG. 23 and 27). After the thread winding operation and the thread hooking operation (to be described later in detail) end, the thread is led through the thread lead hole 302E.

The air nozzle 367*a* is movable between the work position (FIG. 11) and the retract position (FIG. 23) with the aid of the nozzle retracting solenoid 369. For twining the thread round the bobbin shaft, the air nozzle 367*a* is moved to the work position. For the winding, hooking and cutting of the thread, it is moved to the retract position.

The bobbin case 302, the thread cutting point S, the retract position of the air nozzle 367*a*, and the like are disposed such that when the air nozzle 367*a* is set at the retract position, a distance between the thread cutting point S and the tip of the air nozzle 367*a* when the thread is cut is nearly equal to the length LL (already stated) required for twining the thread round the bobbin shaft 307*a* (approximately 55 mm in this embodiment) (FIG. 23).

Figure 25:
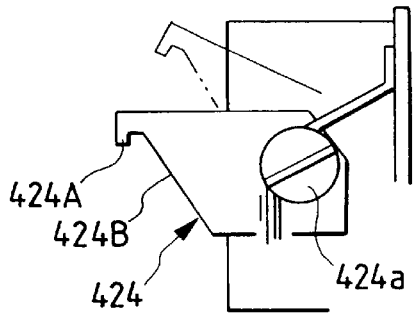
FIG. 25 is a plan view showing a thread catching lever attached to the bobbin thread winding apparatus.
Figure 26:
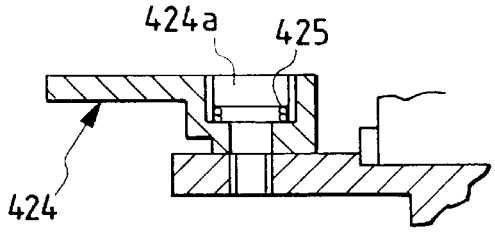
FIG. 26 is a cross sectional view of the thread catching lever of FIG. 25.

When the bobbin case 302 is set at the bobbin thread winding position C, a thread catching lever 424 is rotatably supported by a step screw 424*a* in a plane perpendicular to the paper surface of FIG. 26, under a locus of the rotation of the thread handing member 416 (FIGS. 25, 26, and 28 to 32). The thread catching lever 424, as shown in FIG. 25, includes a hook 424A at the top thereof, and a slanting surface 424B slanting down to the right (in FIG. 25) and continuous to the hook 424A. The thread catching lever 424 is urged counterclockwise (in FIG. 25). Usually, it is positioned as indicated by a solid line in FIG. 25.

A wiper 430, rotatably supported, is provided on this side (in FIG. 28) of the fore end of the winding shaft 350. The wiper 430 is bent at a mid part thereof, and turned by an air cylinder of the rotary type (not shown).

A thread tension varying means 504, which varies a tension of the bobbin thread 450, is provided between the draw-out mechanism F and the thread winder 500 (FIG. 17). The thread tension varying means 504 is formed of a tension spring 505 for pushing the passing bobbin thread 450, a screw 506 for manually adjusting a pushing force of the tension spring 505, and a solenoid SOL, disposed within the sewing machine bed 401, for causing solenoid propelling force that resists the pushing force of the tension spring 505.

An electric circuit for driving the thread tension varying means 504 is constructed such that a power source V is connected in series to the solenoid SOL, and a switch SW is inserted therebetween.

When the switch SW is turned off, the solenoid propelling force is generated. In this state, a maximum of pushing force of the tension spring 505 acts on the bobbin thread 450, and the thread tension is at its maximum. When the switch SW is turned on, a maximum of propelling force is generated. In this state, the result of subtracting the solenoid propelling force from the pushing force of the tension spring 505 acts on the bobbin thread 450. The thread tension is at its minimum.

The residual thread removing apparatus 461 and the bobbin thread winding apparatus 462 come in contact with the base plate 303 (FIGS. 33 to 38). The base plate 303 may be cut out at proper locations. In the illustration of FIG. 33, the bobbin case set/removal position D is located close to the residual thread removing position B and the bobbin thread winding position C, and the holding sections 311 and 311 are exaggerated. In the illustration, there is a danger that the holding sections 311 and 311 come in contact with the residual thread removing apparatus 461 and the bobbin thread winding apparatus 462. Actually, sufficient spaces are secured so as to avoid the contact of them.

In the present embodiment, the bobbin case holding means, driven by the movement motor 318, is movable between the bobbin case set/removal positions (shuttle position; position of the dummy shaft) A and D and the retract position (FIGS. 34 to 38) located apart from the shuttle. When the bobbin case holding means is moved to the retract position, the sensor plate 315 interrupts the light from the light emitting element 341*a* to the light receiving element 341*b* of the movement detector 341, to thereby detect the movement of the bobbin case holding means to the retract position. Then, at the retract position, an origin position is detected. With the turn of the bobbin case holding means at the retract position, the detection plate 332 interrupts the light from the light emitting element 331*a* to the light receiving element 331*b*. The origin position is set at the position of the light interruption by the detection plate 332. By so setting, when the bobbin case holding means is turned to that position, it returns to the origin position. When a pulse motor, for example, is used for the rotation motor 320, the bobbin case holding means may be moved to the shuttle position A, the bobbin thread winding position C, the residual thread removing position B, and the dummy position D through the counting of the number of pulses to the pulse motor.

The automatic bobbin thread supplying apparatus thus constructed will be described.

To cause one of the bobbin case holding means to hold a bobbin case containing a bobbin with a thread wound therearound, a worker inserts his hand from the rotary arm side, and pushes the bobbin case containing the thread-wound bobbin against the dummy shaft 306 without reversing the flat of the hand, as in the case of setting it to the shuttle shaft 305. For ease of explanation, this bobbin case is denoted as 302X, and a bobbin case to be described later is denoted as 302Y.

Then, when the power switch is turned on, the rotary arm 370 is returned to the origin position. The start switch is turned on. In turn, the rotary arm 370 is turned to set the one of the bobbin case holding means at the dummy position D. The rotary arm 370 is caused to advance and one of the bobbin case holding means grasps the bobbin case 302X with the thread-wound bobbin that is held by the dummy shaft 306. At this time, the other of the bobbin case holding means moves to the shuttle body without experiencing any interference.

When the dummy shaft 306 is provided at an opposite location with respect to the transferring shaft 304 of the residual thread removing position B or the bobbin thread winding-position C, the position of the residual thread removing position B when viewed in the axial direction of the transferring shaft, as described above, is coincident with the retract position of the bobbin case holding mean, and the position of the bobbin thread winding position C when viewed in the axial direction of the transferring shaft is coincident with a position slightly moved forward from the retract position of the bobbin case holding means. Therefore, in this state, if one of the bobbin case holding means is moved toward the dummy shaft 306, the other will hit the residual thread removing apparatus 461 and the bobbin thread winding apparatus 462. In this connection, it is noted that in the present embodiment the dummy shaft 306 is located right under the shuttle body 301 while facing the locus of rotation of the bobbin case holding means, as recalled. With this, there is no danger that the bobbin case holding means hits the residual thread removing apparatus and the bobbin thread winding apparatus.

Next, the rotary arm 370 is moved backward while being turned, to thereby direct one of the bobbin case holding means to the shuttle body 301, and move it forward. A bobbin case 302X containing a bobbin with a thread fully turned therearound is set to the shuttle. At this time, the other of the bobbin case holding means moves toward the dummy shaft 306, not meeting with any hindrance. And the rotary arm 370 is moved backward. At this time, as in the previous case, a worker inserts his hand again from the rotary arm side, and sets the bobbin case 302Y containing the thread-wound bobbin to the dummy shaft 306.

After the sewing operation starts, during the sewing operation, as in the previous case, one of the bobbin case holding means is caused to hold the bobbin case 302Y containing the thread-wound bobbin that is caught by the dummy shaft 306, and the rotary arm 370 is moved backward.

When the amount of the residual thread wound is small and a command for bobbin exchange is issued, the sewing operation of the machine is stopped. The bobbin case holding means not holding the bobbin case is moved forward, picks up the bobbin case 302X containing the bobbin having a small amount of the residual thread, from the bobbin case 302X, and is moved backward.

The rotary arm 370 is turned, and the bobbin case 302Y containing the thread-wound bobbin is set facing the shuttle body 301. It is advanced to load the bobbin case 302Y containing the thread-wound bobbin into the shuttle body, and then the rotary arm 370 is retracted therefrom.

After the sewing operation starts, during the sewing operation, the rotary arm 370 is turned, and the bobbin case 2X containing the bobbin having a small amount of the residual thread is moved to the residual thread removing position B. At this position, the residual thread removing apparatus 461 removes the residual thread from the bobbin contained in the bobbin case 302X, to thereby provide an empty bobbin.

The rotary arm 370 is turned to set the bobbin case 302X containing the empty bobbin facing the bobbin thread winding apparatus 462. Further, the rotary arm 370 is advanced, and a thread is wound around the empty bobbin by the bobbin thread winding apparatus 462. The operation of the bobbin thread winding apparatus 462 will be described with reference to FIG. 14 to 32.

A bobbin thread 450 led from the thread winder 200 and the thread tension varying means 504 is wound around the roller 354 by one turn. The thread of one turn is passed through a hole of the looseness correcting lever 362. At this time, the switch SW of the thread tension varying means 504 is turned on, to thereby maximize the solenoid propelling force and to minimize the thread tension.

The end of the bobbin thread 450 is inserted into the absorbing hole 365*a* of the thread absorber 365 and somewhat is pushed thereinto. Then, the electromagnetic valve 368 is temporarily turned on. Air is fed from the air source to the air tubes 366 and 367. With the air stream, the bobbin thread 450 that has been pushed in the absorbing hole 365*a* is guided to the air nozzle 367*a*, and exposed and led from the air nozzle 367*a*. The length LL of the lead-out thread end is long enough to twin the thread end around the bobbin shaft. In this embodiment, it is approximately 5.5 mm. When the bobbin thread 450 that has been pushed in the absorbing hole 365*a* is transported from the output shaft 356, and exposed and led from the air nozzle 367*a*, it is preferable for a worker to pull a sufficient length of the thread from the thread winder 500 in advance or to draw it out in advance.

Then, the bobbin case 302 that is moved to the bobbin thread winding position C by the turn of the rotary arm 370 is advanced by the advancing motion of the rotary arm 370. The bobbin drive motor M2 is temporarily driven, to thereby couple the clutch mechanism 350*a* with the bobbin 307.

As shown in line (b) of FIG. 19, the bobbin drive motor M2 is driven at low speed, so that the bobbin is turned at low speed. As shown in line (d) of FIG. 19, an OFF signal is applied to the nozzle retracting solenoid 369, so that the air nozzle 367*a* is moved to the work position near the opening 302A of the bobbin case 302. As shown in line (a) of FIG. 19, the electromagnetic valve 368 is turned on, so that air is fed from the air source to the air tubes 366 and 367.

As shown in FIG. 11, the thread end led from the air nozzle 367*a* is well introduced (guided) into the bobbin case 302 from the opening 302A of the bobbin case 302 while being little flapped, and also to the thread-winding side XX of the bobbin shaft. With the aid of the turn of the bobbin shaft 307*a* and an eddy current of air, the bobbin thread gets twisted round the bobbin shaft.

Thus, the bobbin thread 450 supplied from the thread winder 500 gets twisted round the bobbin shaft 307*a*. In turn, the roller 354 starts to turn. The photo sensor 360 produces a pulse signal as shown in line (e) of FIG. 19. The effective thread winding amount counting means 361 counts the number of pulses of the pulse signal from the photo sensor. When the number of pulses reaches a preset value, it is decided that the bobbin thread 450 has been entwined round the bobbin shaft. In this embodiment, such a decision is determined when three pulses are counted. The number, three, of pulses are selected allowing for a safety factor. Thence, the number of pulses required is not limited to three, as a matter of course.

After the twining of the bobbin thread 450 round the bobbin shaft 307*a* is detected, the effective thread winding amount counting means 361 counts the pulses for the effective thread winding amount, subsequently. At this time, as shown in line (a) of FIG. 19, the electromagnetic valve 368 is turned off, and thereby the air supply from the air source is stopped. As shown in line (c) of FIG. 19, with a slight time lag, an ON signal is applied to the nozzle retracting solenoid 369, and the air nozzle 367*a* is moved to the retract position, as shown in FIG. 23.

Figure 20:
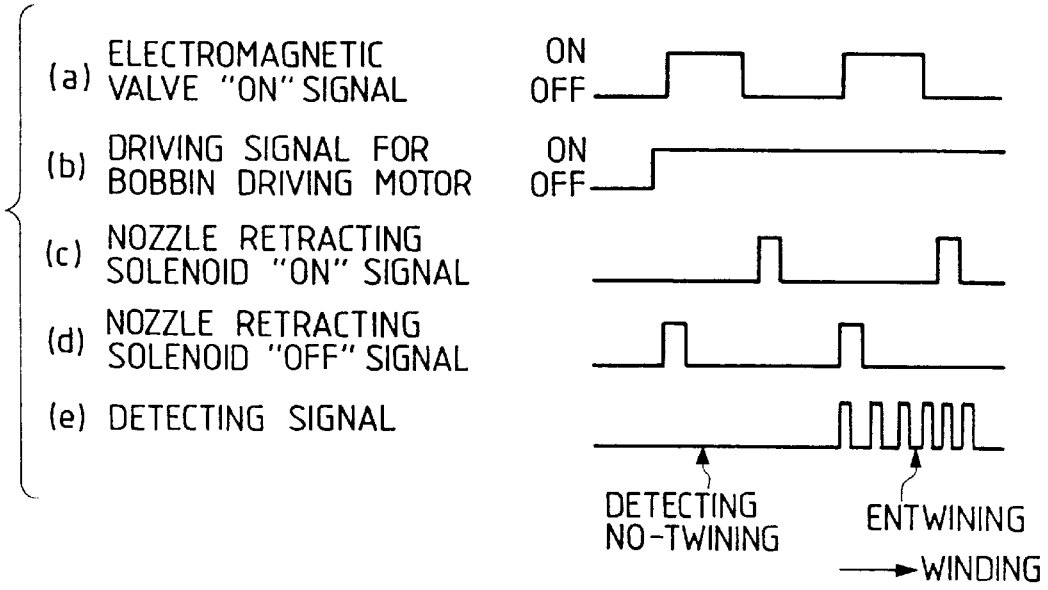
FIG. 20 is a timing chart showing a retry operation of the bobbin thread winding apparatus.

When the bobbin thread 450 fails to be entwined round the bobbin shaft 307*a*, and as shown in line (a) of FIG. 20, the photo sensor 360 produces no pulse signal, the electromagnetic valve 368 is turned off and the air supply from the air source is stopped, as shown in line (a) of FIG. 20. With a slight time lag, an ON signal is applied to the nozzle retracting solenoid 369, as shown in line (c) of FIG. 20. The air nozzle 367*a* is moved to the retract position, setting up an initial state.

An ON signal is applied again to the nozzle retracting solenoid 369, as shown in line (d) of FIG. 20, and the air nozzle 367*a* is moved to the work position near the opening 302A of the bobbin case 302. As shown in line (a) of FIG. 20, the electromagnetic valve 368 is turned on, so that air is fed from the air source to the air tubes 366 and 367. That is to say, a retry operation is performed. In this embodiment, the number of the retry operations is three times. If the twining of the thread round the bobbin shaft 307*a* is not detected after three retry operations, the machine decides that something is wrong with the machine itself, and issues an alarm sound to urge the worker to take some measure for the trouble.

As already stated, when the twining of the thread round the bobbin shaft 307*a* is detected and the air nozzle 367*a* is moved to the retract position (FIG. 23), the motor speed of the bobbin drive motor M2 is increased from the low speed, to wind a bobbin thread around the bobbin shaft 307*a*. When the bobbin thread is progressively wound with a long distance between the tip of the air nozzle 367*a* and the bobbin shaft 307*a*, the bobbin thread 450 is uniformly wound over the entire length of the bobbin shaft 307*a*.

The determining means 361B compares the amount of the actual winding thread that is detected by the effective thread winding amount counting means 361, with a preset amount of winding thread that is entered from a thread amount setting means 361A. When both the amounts are equal to each other, a drive stop signal is applied to the driver 361C of the bobbin drive motor M2. As a result, the bobbin drive motor M2 is stopped. That is, the preset amount of winding thread entered from the thread amount setting means 361A is wound around the bobbin shaft 307*a*.

Just before the preset amount of winding thread is reached, the motor speed of the bobbin drive motor M2 is reduced, the reduced motor speed is continued, and the motor is stopped when the preset amount of winding thread is reached. If so done, the motor does not overrun, and hence the preset amount of winding thread may be used as an actual winding thread amount.

After the winding operation of the bobbin thread 450 round the bobbin 307 is automatically carried out, the switch SW of the thread tension varying means 504 is turned off, to minimize the solenoid propelling force and to maximize the thread tension. In this state, the thread 450 that is led from the opening 302A of the bobbin case 302 is hooked to the bobbin case 302. The thread hooking operation will be described hereinafter.

Figure 28:
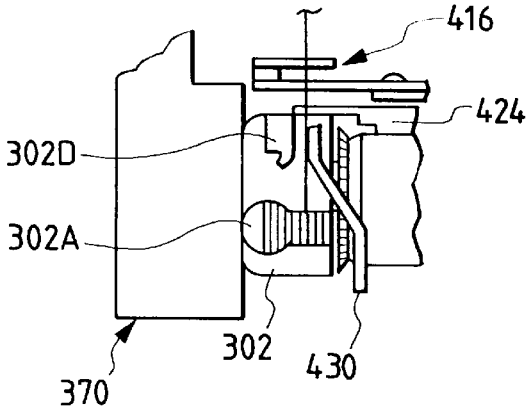
FIG. 28 is a side view showing a key portion of the bobbin thread winding apparatus when a bobbin thread is wound.

To start with, the thread handing member 416 is half turned from an initial position shown in FIG. 28, and set at a position shown in FIG. 29. Then, the bobbin thread 450 (FIG. 27) that is led from the opening 302A of the bobbin case 302 is caught by the vertex of the V-shaped cutting portion 416D, and moves to a hooking position 302B located closer to the tension spring of the bobbin case 302 (FIG. 29).

Figure 30:
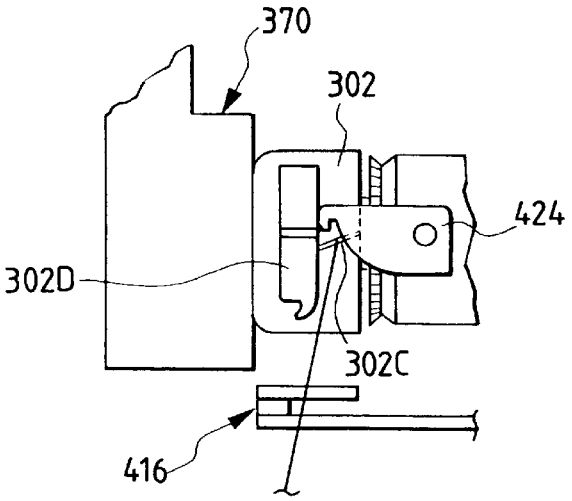
FIG. 30 is a plan view showing a key portion of the bobbin thread winding apparatus when another thread guiding operation, which follows the thread guiding operation shown in FIG. 29, is performed.

At this time, the thread moving toward the hooking position 302B comes in contact with a slanting surface 424B of the thread catching lever 424, and pushes the thread catching lever 424 in its advancing direction. At this time, the thread catching lever 424 is being urged in the direction opposite to the advancing direction, by a coiled spring 425. Accordingly, as shown in FIG. 29, the bobbin thread 450 pushes the thread catching lever 424 in the advancing direction a preset distance, and is guided to a slit 302C at a thread catching position. Thereafter, the thread handing member 416 is half turned in the reverse direction, and the thread handing member 416 is returned to the original position (FIG. 30).

Figure 31:
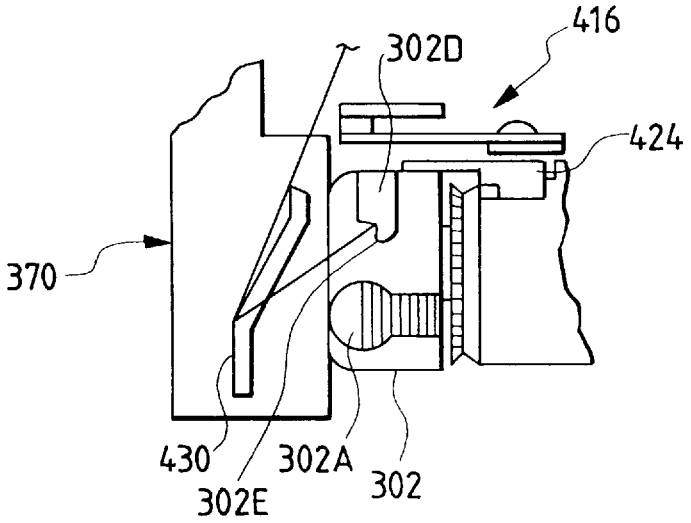
FIG. 31 is a side view showing a key portion of the bobbin thread winding apparatus when the thread is hooked under a thread tension spring of the bobbin case.

Subsequently, the wiper 430 is turned, as shown in FIG. 31, from the initial position, by approximately 180° (FIG. 21). A part of the thread led out of the slit 302C is hooked to the wiper 430, and the thread part that has been inserted in the slit 302C goes under the tension spring 302D, and is led from the thread lead hole 302E. Thereafter, the wiper 430 is returned to the initial position.

A bevelled part 302*a* is formed in the bobbin case 302 in the present embodiment, as shown in FIG. 27. With provision of the bevelled part 302*a*, the bobbin thread 450 that is led from the bevelled part 302*a* of the bobbin case is easily moved to the hooking position 302B closer to the tension spring located under the bobbin case 302. Provision of the bevelled part 302*a* does not affect any adverse influence to the quality of stitching. Where the bobbin thread 450 that is led from the bevelled part 302*a* of the bobbin case is easily moved to the hooking position 302B, there is no need of providing the bevelled part 302*a*.

Following the automatic operation of hooking the thread to the bobbin case 302, the thread supplied to the bobbin case 302 to which the thread is hooked is cut. To begin with, the switch SW of the thread tension varying means 504 is turned on, to maximize the solenoid propelling force and to minimize the thread tension.

The thread handing member 416 is turned in the reverse direction when compared with the case of FIG. 29. In turn, as shown in FIG. 32, the bobbin thread 450 that is led from the thread lead hole 302E under a thread tension spring 302D of the bobbin case 302, is caught by the vertex of the V-shaped cutting portion 416C, and the thread is pulled out.

The pulled out thread is caught by the vertex of the V-shaped cutting portion 416C and is separated to the right in FIG. 32 by the thread separating piece 416B.

And the thread handing member 416 is turned in the same direction. Then, the cutting eye ball 416E of the thread handing member 416 faces the stationary blade 391, and the thread present therebetween is cut (FIGS. 23 and 32).

The bobbin thread from the bobbin case 302 is led from the thread lead hole 302E under the tension spring 302D by a length thereof of approximately 40 mm, and is cut. The length of 40 mm is long enough for the bobbin or lower thread to form a seam in cooperation with the upper thread, as already referred to.

The thread from the thread winder 500, as described above, is led out of the air nozzle 367*a* by the length LL of approximately 55 mm. The length of 55 mm is long enough to twine the under thread round the bobbin shaft 307*a*.

After the automatic operation of cutting the lower thread is carried out, the rotary arm 370 is moved backward to be in a stand-by state. When a bobbin exchange command is issued, the sewing operation of the sewing machine is stopped. The rotary arm 370 is turned. The bobbin case holding means not holding the bobbin case is set facing the shuttle body 301, and it is moved forward. A bobbin case 302Y containing a bobbin with a less amount of residual thread wound therearound is pulled out of the shuttle. Then, the rotary arm 370 is moved backward.

Then, the rotary arm 370 is turned and advanced. A bobbin case 302X containing a bobbin with a thread that is wound therearound by the bobbin thread winding apparatus 462, is set into the shuttle body. The rotary arm 370 is moved backward. A sequence of the above operations is repeated.

When the bobbin case 302 (302X, 302Y) held by the bobbin case holding means is pulled out or when the bobbin case 302 is temporarily held by the dummy shaft 306 in order to use another thread of different color, the bobbin case holding means which holds the bobbin case 302 is placed facing the dummy shaft 306, and it is moved forward. As a result, the bobbin case 302 is transferred from the bobbin case holding means to the dummy shaft 306.

To pull out the bobbin case 302 that is held by the dummy shaft 306, as in the case of pulling the bobbin case 302 from the shuttle shaft 305, it can be pulled out by inserting the hand of a worker from the [rotary arm side, without reversing the flat of the hand. The manual operation of pulling the bobbin case from the dummy shaft 306 is very easy.

Thus, in the present embodiment, the thread supplied from the thread winder 500 is led out of the air nozzle 367*a* by the length LL thereof necessary for the thread to gets twisted round the bobbin shaft 307*a*, by the air guiding means G as an thread insertion means. The thread let out is inserted into the bobbin case 302 through the opening 302A of the bobbin case. The thread that is inserted into the bobbin case 302 by the air guiding means G is made to twine around the bobbin shaft 307*a* with the aid of the air as thread twining means and the turn of the bobbin caused by the bobbin drive motor M2 as bobbin drive means. The bobbin shaft 307*a* with the twined thread is turned by the bobbin drive motor M2, so that the bobbin thread is wound around the bobbin 307 contained in the bobbin case 302. The bobbin thread supplied from the thread winder 500 securely gets twisted round the bobbin shaft 307*a* and is wound around the bobbin shaft, without a mechanism for forcibly drawing the thread out of the thread supply source as disclosed in the first embodiment. No use of the thread draw-out mechanism leads to reduction of cost to manufacture, and eliminates the trouble of the thread getting entangled, which is caused by the mechanism. Improvement of the machine reliability is secured.

In the present embodiment, the thread of the length LL necessary for the thread to get twisted round the bobbin shaft is led out of the air nozzle 367*a*. Accordingly, in the next and the subsequent operations of winding the thread on the bobbin case, as in the previous case, the bobbin drive motor M2 is driven at low speed, and hence the bobbin is also turned at low speed. The air nozzle 367*a* is moved to the work position. The electromagnetic valve 368 is turned on, and air is fed from the air source to the air tubes 366 and 367. Then, with the cooperation of the turn of the bobbin shaft 307*a* and air, the thread let out of the air nozzle 367*a* gets twisted round the bobbin shaft. That is, the thread automatically gets twisted round the bobbin shaft without a draw-out motor.

In the present embodiment, when the bobbin thread is wound around the bobbin shaft 307*a*, the tip of the air nozzle 367*a* is moved from the work position to the retract position, whereby a distance between the tip of the air nozzle 367*a* and the bobbin shaft 307*a* is increased. The bobbin thread 450 is uniformly wound over the entire length of the bobbin shaft.

In the present embodiment, when the bobbin thread that is let from the opening 302A of the bobbin case is hooked to the bobbin case 302, the tip of the air nozzle 367*a* is moved from the work position to the retract position, whereby no interference of the tip of the air nozzle 367*a* with the thread handing member 416 takes place. The machine reliability is improved.

In the present embodiment, when the bobbin thread is cut, the air nozzle 367*a* is moved apart from the work position to the retract position, whereby no interference of the air nozzle 367*a* with the thread handing member 416 takes place. The machine reliability is improved.

In the present embodiment, the direction of the air blown from the air nozzle 367*a* is closer to the thread-winding side XX of the outer surface of the bobbin shaft than a line YY that is prolonged from the tip of the air nozzle 367*a*, while passing through the center of the bobbin shaft. Therefore, the bobbin thread inserted into the bobbin case 302 securely gets twisted round the bobbin shaft with the aid of the air stream and the turn of the bobbin shaft. The machine reliability is improved.

In the present embodiment, the effective thread winding amount counting means 361 detects the twining of the thread around the bobbin shaft 307*a*. Therefore, the amount of the thread after it twines round the bobbin shaft is detected as the amount of the wound bobbin thread, for example, and an accurate winding of the bobbin thread is realized.

In the present embodiment, when the effective thread winding amount counting means 361 fails to detect the twining of the thread around the bobbin shaft 307*a*, the operation for twining the bobbin thread round the bobbin shaft 307*a* is repeated or continued. Through the repeating and continuous twining operation, the possibility that the thread twines round the bobbin shaft 307*a* is improved. Accordingly, the machine reliability is improved.

The present embodiment further has the following useful effects. The bobbin thread winding apparatus is located under the sewing machine bed 401. The residual thread removing position B and the bobbin thread winding position C are facing the locus of the rotating bobbin case holding means in an area V below the transferring shaft 304 that rotates together with the bobbin case holding means, and an area W containing a pivot 403 about which the sewing machine bed 401 is turned when it is raised from a vertical plane along the transferring shaft 304. The residual thread removing apparatus 461 and the bobbin thread winding apparatus 462 are inwardly apart from the rotation locus X of the outer surface side when the machine head is raised. There is no chance that the interference (contact) of the sewing table 402 with the apparatus (residual thread removing apparatus 461 and the bobbin thread winding apparatus 462) may occur with the sewing table 402 when the sewing machine bed 401 is raised. This is achieved without reducing and accurately working the component parts of those apparatuses. This brings about various benefits. The cost to manufacture is reduced. Easy and simple assembling, wiring, and piping are realized. Easy maintenance is secured. Further, those apparatuses are closely disposed. Then, the wiring and piping may be concentrated to a specific space, resulting in the space saving. Further, an excessive turn of the bobbin case holding means is removed.

The lower shafts 404 and 405 of the sewing machine are closely disposed in a location facing the rotation locus of the bobbin case holding means and above the transferring shaft 304 that is turned together with the bobbin case holding means (FIG. 33). For this reason, it is difficult to lay out the bobbin thread winding apparatus 462 and the residual thread removing apparatus 461 in this region.

When the bobbin case holding means is axially moved to the bobbin case set/removal position (shuttle position) A, the bobbin case holding means (referred to as a second bobbin case holding means) of the rotary arm 370 that is oppositely located with respect to the transferring shaft 304, is also moved in the axial direction. Therefore, a space into which the second bobbin case holding means escapes must be formed in the path of the second bobbin case holding means, for preventing its interference with others. In this connection, in the present embodiment, the dummy shaft 306 is located right under the shuttle body, while facing the rotation locus of the bobbin case holding means. When the bobbin case holding means is axially moved to the bobbin case set/removal (shuttle position) A, and to the dummy shaft 306, the design is made so that the second bobbin case holding means does not interfere with its near members. Therefore, there is no need for additionally providing the escaping space.

In the construction of the residual thread removing apparatus 461, the thread is drawn out of the bobbin in a manner that the bobbin is turned by a thread draw-out operation of a thread draw-out means which draws out a thread that is wound on the bobbin and hangs down from a thread lead hole of the bobbin case 302. Therefore, its major portion is located below the residual thread removing position B. Accordingly, if the residual thread removing position B is exchanged with the bobbin thread winding position C, there is no room for the major portion of the residual thread removing apparatus 461. In connection with this, in the present embodiment, the residual thread removing position B is located below the bobbin thread winding position C. And an empty space is provided below the residual thread removing position B. Therefore, the residual thread removing apparatus 461 may be installed in this empty space. Further, the residual thread removing position is located below the bobbin thread winding position. Because of this, there is no chance that thread removed from the residual thread removing position gets twisted around other things, for example, the bobbin thread winding position. The removal thread is smoothly discharged.

While the present invention has been described using a specific embodiment thereof, it should be understood that the embodiment may variously be changed, modified, and altered within the scope of the invention. In the above-mentioned embodiment, the bobbin thread is inserted into the bobbin case through the opening 302A of the bobbin case 302 in a state that the bobbin thread supplied from the thread winder 500 is pulled out by the length LL long enough to twine the thread round the bobbin shaft 307*a*, by the air guiding means G. In a modification of the air guiding means G, the bobbin thread from the thread winder 500 is inserted into a short tubular member. A thread gripping means is provided, which is able to grip the inserted thread and to release the grip of the thread. The short tubular member holds the thread in a state that the thread part of the length LL long enough to twine the thread round the bobbin shaft 307*a* is pulled out of the short tubular member. In this state, the tubular member is moved to the work position. Subsequently, it is always placed in a released state. The tubular member is moved between the work position and the retract position as in the above-mentioned embodiment. In the modification, an air means must be additionally used, which guides the thread let from the fore end of the tubular member into the bobbin case 302, and is twined around the bobbin shaft 307*a*.

In the above-mentioned embodiment, the thread is twined around the bobbin shaft 307*a* with the aid of the air by the air guiding means G and the turn of the bobbin by the bobbin drive motor M2, in a state that the thread part of the length LL long enough to twine the thread round the bobbin shaft 307*a* is inserted into the bobbin case 302. The air may be substituted by the mechanism disclosed in Japanese Patent Application No. Hei. 5-239194, filed by the applicant of the present Patent Application. In this case, the bobbin thread that is placed in the bobbin case 302 is hooked to a key-like piece of a key-shaped thread catching member protruded from the outer surface of the bobbin shaft 307*a*, with a low speed rotation of the bobbin drive motor M2. Then, it is put in a ring-like groove that is formed in the outer surface of the bobbin shaft 307*a* located behind the thread hooking member. The depth of the ring-like groove on the thread-end side is deeper than that of the groove on the thread-supply side. The thread on the thread-end side is laid under the thread on the thread-supply side. In this way, the bobbin thread is twined around the bobbin shaft.

Additionally, the short tubular member is used for the thread insertion means. The thread catching member and the ring-like groove may be used for the thread twining means. Also in this modification, the beneficial effects of the above-mentioned embodiment are secured.

In the above-mentioned embodiment, means for inserting the bobbin thread into the bobbin case through the opening 302A of the bobbin case 302 in a state that the thread of the length LL is long enough to twine the thread around the bobbin shaft 307*a* 06 it is drawn out of the thread winder 500, and means for twining the thread that is inserted into the bobbin case 302 by the former means, around the bobbin shaft 307*a* are constructed by a single means (air guiding means G). Those may separately be constructed, as matter of course.

In the above-mentioned embodiment, to secure a high accuracy of the bobbin thread winding amount, an actual bobbin thread winding amount is detected using the turn of the roller 354. In another possible detecting mechanism, a rotation detecting apparatus, such an encoder, is attached to the bobbin drive motor M2. The bobbin thread winding amount is detected by using the turn of the bobbin. The detecting mechanism is inferior to that of the embodiment in the detection accuracy. Additionally, the bobbin thread winding amount that is detected on the basis of the turn of the bobbin, is corrected by using a computing means, for example (in an example of the correction, as the diameter of the wound thread is larger, the length of the wound thread is longer even if the number of revolutions remains unchanged). The detection accuracy is improved.

In the above-mentioned embodiment, the bobbin thread let from the thread lead hole 2E under the tension spring 302D of the bobbin case 302 is cut. The thread that is let from the opening 302A of the bobbin case 302, not hooked, may be cut, as a matter of course.

In the above-mentioned embodiment, when the thread is hooked and cut, the air nozzle 367*a* is retracted to the retract position in order to avoid its interference with the thread handing member 416. Where the mechanisms of hooking and cutting the thread are designed such that it does not interfere with the air nozzle 367*a* at the time of thread hooking and cutting, the air nozzle 367*a* may be fixed at the work position. In this case, the stationary blade 391, for example, must be moved so that the distance between the thread cutting point at the time of thread cutting and the tip of the air nozzle 367*a* is substantially equal to the length long enough to twine the thread around the bobbin shaft 307*a*.

In the above-mentioned embodiment, the bobbin case 302 is fixed, while the thread handing member 416 is moved, for cutting the thread. If required, the thread handing member 416 is fixed, while the bobbin case 302 is turned or moved. Further, the thread handing member 416 and the bobbin case 302 may be both moved for the same purpose.

In the above-mentioned embodiment, the thread handling member 416 has both the functions of the thread hooking and the thread cutting. If required, those functions may be exercised by separate means.

In the above-mentioned embodiment, the nozzle retracting solenoid 369 and the spring 870 cooperates to move the air nozzle 367*a* between two positions, the work position and the retract position. Instead of using the nozzle retracting solenoid and the spring, a stepping motor may be used for moving the air nozzle 367*a* between the two positions (in this case, the retract position is located farther apart from the opening 302A of the bobbin case 302 than in the above-mentioned embodiment). When the thread is cut, the air nozzle 367*a* is positioned relative to the work position and the retract position (as in the above-mentioned embodiment) so that the distance between the tip of the air nozzle 367*a* and the thread cutting point S is substantially equal to the length long enough to twine the thread around the bobbin shaft 307*a*. When the bobbin thread is wound, the tip of the air nozzle 367*a* is moved to the retract position so as to maximize the distance between it and the bobbin shaft 307*a* (farther apart from the position in the above-mentioned embodiment), so that the bobbin thread is uniformly wound over the entire length of the bobbin shaft.

In the above-mentioned embodiment, the bobbin case holding means is the dummy shaft 306. Alternatively, a magnet may be used. The magnet attracts the bobbin case 302 and inserts it into the holder.

In the above-mentioned embodiment, in the retry operation, the air nozzle 367*a* is moved to the retract position, and to the work position again. If the thread is inserted onto the side of the bobbin shaft which is opposite to the thread-winding side XX thereof, the thread is pulled out, and inserted into the bobbin case again. The re-insertion may be carried out in a state that the air nozzle 367*a* is stopped at the work position. As indicated by phantom lines in FIG. 14, a pair of rollers 900 and 900, which are turned in the forward and the reverse directions by a drive motor, not shown, are provided in the thread supply path. The paired rollers 900 and 900 may be pressed against the bobbin thread 450 and detach from the thread. Usually, the rollers are apart from the thread. In a retry mode, the rollers are pressed against the thread 450 and turned, to thereby return the thread of a preset length to the thread winder 500. Then, the rollers 900 and 900 are turned in the reverse direction, to thereby feed the thread of the equal length to the bobbin case 302. By so constructed, the re-insertion may be carried out while the air nozzle 367*a* is stopped at the work position. When the twining of the bobbin thread 450 around the bobbin shaft 307*a* is detected, the rollers 900 and 900 detach from the thread 450, as a matter of course.

In the bobbin thread winding apparatus according to the first aspect, the bobbin thread is drawn out of the thread supply source by the thread draw-out means, and guided to the opening of the bobbin case by the air guide means. The thread guided to the bobbin case opening is further drawn out by the thread draw-out means, and fed into the bobbin case by an air stream from the air guide means. With the rotation of the bobbin caused by the bobbin drive means, the thread securely gets twisted around the bobbin case.

With such a construction, the thread will never be forced out of the bobbin case, a good seam is formed, and the thread is not cut. Further, the thread end does not slip off, the thread is not wound around a shaft other than the bobbin shaft, and hence any manual operation is not required for resetting the thread to the clamping mechanism. Accordingly, the reliability of the bobbin thread winding apparatus is improved.

In the bobbin thread winding apparatus according to the second aspect, insertion means inserts the tip of the bobbin thread supplied from a thread supply source into the bobbin case through an opening of the bobbin case. The bobbin drive control means controls the bobbin drive means so that the bobbin thread inserted into the bobbin case gets twisted round the bobbin shaft with the turn of the bobbin. The twisting of the bobbin thread round the bobbin shaft is detected on the basis of the output signal of the thread winding detecting means. The bobbin thread winding apparatus of the second aspect, which has the useful effects of the first aspect bobbin thread winding apparatus, can detect the amount of the thread wound around the bobbin shaft after it gets twisted round the bobbin shaft, and hence can accurately detect an effective thread winding amount of the thread on the bobbin.

With the construction of detecting the start of winding the thread, it is possible to detect an winding error and no supply of the bobbin thread from the thread supply source.

In the bobbin thread winding apparatus according to the third aspect, a bobbin thread is drawn out of the thread supply source by the draw-out roller driven by the draw-out roller drive means. The thread drawn out is guided to the opening of the bobbin case by the air guide means. The thread guided to the opening is further drawn out of the thread supply source by the draw-out roller driven by the draw-out roller drive means. It is fed into the bobbin case by an air stream from the air guide means. With the turn of the bobbin caused by the bobbin drive means, the thread securely gets twisted round the bobbin shaft. The turn of the draw-out roller is detected by the roller turn detecting means. The speed of the draw-out roller is smaller than the speed of the bobbin. Therefore, when the thread gets twisted round the bobbin shaft, the one-way clutch interrupts the transmission of the rotation of the draw-out roller drive means to the draw-out roller. The output signal of the roller turn detecting means, which has indicated the roller speed of the draw-out roller, is caused to indicate the bobbin speed. The twisting of the bobbin thread around the bobbin shaft, and the effective thread winding amount of the thread wound on the bobbin shaft are detected. The effective thread winding amount is set to be the amount of the thread that is wound on the bobbin shaft after the thread gets twisted around the bobbin shaft. And it depends on the rotation of the draw-out roller, not the rotation of the bobbin.

The bobbin thread winding apparatus according to the third aspect, which has the useful effects of the first aspect bobbin thread winding apparatus, can accurately detect an effective thread winding amount of the bobbin thread irrespective of the yarn count of the thread used. Further, with provision of the one-way clutch, a load of the draw-out roller drive means is not applied to the bobbin drive means, whereby any adverse effect is not exerted on the stitching quality.

In the bobbin thread winding apparatus according to the fourth aspect, insertion means inserts the tip of the bobbin thread supplied from a thread supply source into the bobbin case through an opening of the bobbin case. The bobbin drive control means controls the bobbin drive means so that the bobbin thread inserted into the bobbin case gets twisted round the bobbin shaft with the turn of the bobbin. The twisting of the bobbin thread round the bobbin shaft is detected on the basis of the output signal of the thread winding detecting means. When the start of winding the bobbin thread around the bobbin shaft is detected on the basis of the output signal of the thread winding detecting means, the thread winding amount detecting means starts to detect the amount of the thread wound around the bobbin shaft under control of the bobbin drive control means.

The bobbin thread winding apparatus according to the fourth aspect, which has the useful effects of the first aspect bobbin thread winding apparatus, can detect the amount of the thread wound around the bobbin shaft after it gets twisted around the bobbin shaft, as the amount of the winding thread, and hence can accurately detect an effective thread winding amount of the thread on the bobbin. The twisting of the thread around the bobbin shaft and the amount of the thread may be detected separately.

In the bobbin thread winding apparatus according to the fifth aspect, insertion means inserts the tip of the bobbin thread supplied from a thread supply source into the bobbin case through an opening of the bobbin case. The bobbin drive control means controls the bobbin drive means so that the bobbin thread inserted into the bobbin case gets twisted and wound around the bobbin shaft with the turn of the bobbin. The amount of the thread wound around the bobbin shaft is detected by the thread winding detecting means, for example, a photo sensor. The thread supply amount determining means determines the amount of the bobbin thread supplied from a thread supply source by the thread winding amount detecting means, on the basis of the amount of the winding thread. It is possible to know an abnormal supply of the bobbin thread from the determined amount of the bobbin thread. Examples of the abnormal supply of the bobbin thread are a state that the thread is used up and a state that the thread gets entangled in the thread supply path.

In the bobbin thread winding apparatus according to the sixth aspect, the thread guide direction of the air guide means lies on the thread-winding side on the circumference of the bobbin shaft. The thread fed into the bobbin case firmly gets twisted round the bobbin shaft by the cooperation of the air stream and the rotation of the bobbin shaft.

In the bobbin thread winding apparatus according to the seventh aspect, thread insertion means pulls a bobbin thread of a length long enough to twine the thread round the bobbin shaft from a thread supply source, and inserts the pulled-out bobbin thread into the bobbin case through an opening of the bobbin case. The thread twining means, in cooperation with the thread insertion means, twines the bobbin thread that is inserted into the bobbin case by the thread insertion means round the bobbin shaft. The bobbin drive means turns the bobbin shaft around entwined with the bobbin thread to wind the bobbin thread around the bobbin contained in the bobbin case. With such a construction, in the subsequent operation, a bobbin thread supplied from the thread supply source securely gets twisted around the bobbin shaft and is wound around the bobbin shaft, without a mechanism for forcibly drawing the thread out of the thread supply source. No use of the thread draw-out mechanism leads to reduction of cost to manufacture, and eliminates the trouble of thread getting entangled, which is caused by the mechanism. Improvement of the machine reliability is secured.

In the bobbin thread winding apparatus of the eighth aspect, the air guide means is used for the thread insertion means in the seventh aspect. With the air guide means, a bobbin thread supplied from the thread supply source is guided to an opening of the bobbin case along a thread guide path. The bobbin thread of such a length long enough to twine the bobbin thread round the bobbin shaft is pulled out, and the pulled-out bobbin thread is inserted into the bobbin case through an opening of the bobbin case, with the aid of air stream. The bobbin thread winding apparatus thus constructed has the useful effects comparable with those of the seventh aspect apparatus.

In the bobbin thread winding apparatus of the ninth aspect, the air means is used for the thread twining means in the seventh aspect. The bobbin thread introduced into the bobbin case by the thread insertion means gets twisted round the bobbin shaft, with the aid of an air stream caused by the air means and the turn of the bobbin caused by the bobbin drive means. The bobbin thread winding apparatus thus constructed has the useful effects comparable with those of the seventh aspect apparatus.

In the bobbin thread winding apparatus of the tenth, in addition of the construction of the first aspect, the bobbin thread that is wound around the bobbin shaft and let from the opening of the bobbin case, is hooked to the bobbin case by the thread hooking means, and is led out under a thread tension spring. The bobbin thread winding apparatus thus constructed has the useful effects comparable with those of the first aspect apparatus, and further realizes an automatic thread hooking function.

In the bobbin thread winding apparatus of the eleventh aspect, in addition to the construction of the seventh or tenth aspects, the cutting means, which moves relative to the bobbin case, cuts the bobbin thread that is wound around the bobbin shaft and led out of the bobbin case (corresponding to the bobbin thread led from the opening of the bobbin case in the seventh aspect, and the bobbin thread led under the tension spring in the tenth aspect), while leaving a preset amount of the wound bobbin thread. A distance between a thread cutting point when the bobbin thread is cut by the cutting means and the fore end of the thread insertion means is substantially equal to the length long enough to twine the bobbin thread round the bobbin shaft. With this construction, after the thread is cut, the fore end of the thread insertion means surely provides the thread of the length long enough to twine the bobbin thread round the bobbin shaft. Accordingly, in the subsequent operation, a bobbin thread supplied from the thread supply source securely gets twisted round the bobbin shaft and is wound around the bobbin shaft, without a mechanism for forcibly drawing the thread out of the thread supply source, in addition to the useful effects of the seventh or tenth aspect apparatus.

In the bobbin thread winding apparatus of the twelfth aspect, in addition to the construction of the seventh aspect, when the bobbin thread is wound around the bobbin shaft, the fore end of the thread insertion means is moved apart from the work position by the moving means, whereby a distance between the fore end of the thread insertion means and the bobbin shaft is increased. The bobbin thread is uniformly wound over the entire length of the bobbin shaft, in addition to the useful effects of the seventh aspect apparatus.

In the bobbin thread winding apparatus of the thirteenth aspect, in addition to the construction of the tenth aspect, when and the bobbin thread that is led from the opening of the bobbin case is hooked to the bobbin case, the fore end of the thread insertion means is moved apart from the work position by the moving means, whereby no interference of the fore end of the thread insertion means with the hooking means takes place. The machine reliability is improved in addition to the useful effects of the tenth aspect apparatus.

In the bobbin thread winding apparatus of the fourteenth aspect, in addition to the construction of the eleventh aspect, when the bobbin thread is cut, the fore end of the thread insertion means is moved apart from the work position by the moving means, whereby no interference of the fore end of the thread insertion means with the thread cutting means takes place. The machine reliability is improved in addition to the useful effects of the eleventh aspect apparatus.

In the bobbin thread winding apparatus of the fifteenth aspect, in addition to the construction of any of twelfth to fourteenth aspects, the fore end of the thread insertion means may be set at either of a work position and a retract position. When the bobbin thread is cut, for example, the fore end of the thread insertion means is distanced from the work position and the retract position so that a distance between a thread cutting point when the bobbin thread is cut by the cutting means and the fore end of the thread insertion means is substantially equal to the length long enough to twine the bobbin thread round the bobbin shaft. When the thread is wound, for example, the fore end of the thread insertion means is moved to the retract position so as to maximize the distance between it and the bobbin shaft, so that the bobbin thread is uniformly wound over the entire length of the bobbin shaft.

In the bobbin thread winding apparatus of the sixteenth aspect, in addition to the construction of the ninth aspect, the direction of the air blown from the air means is closer to the thread-winding side of the outer surface of the bobbin shaft than a line that is prolonged from the tip of the air means, while passing through the center of the bobbin shaft. Therefore, the bobbin thread inserted into the bobbin case securely gets twisted round the bobbin shaft with the aid of the air stream and the turn of the bobbin shaft. The machine reliability is improved in addition to the useful effects of the ninth aspect apparatus.

In the bobbin thread winding apparatus of the seventeenth aspect, in addition to the construction of the seventh aspect, the thread-twining detecting means detects the twining of the thread around the bobbin shaft. Therefore, the amount of the thread after it twines around the bobbin shaft is detected as the amount of the wound bobbin thread, for example, and an accurate winding of the bobbin thread is realized, in addition to the useful effects of the seventh aspect apparatus.

In the bobbin thread winding apparatus of the eighteenth aspect, in addition to the construction of the seventeenth, when the thread-twining detecting means fails to detect the twining of the thread around the bobbin shaft, the operation for twining the bobbin thread around the bobbin shaft is repeated or continued. Through the repeating and continuous twining operation, the possibility that the thread twines around the bobbin shaft is improved. Accordingly, the machine reliability is improved in addition to the useful effects of the seventeenth apparatus.

What is claimed is:

1. A bobbin thread winding apparatus comprising:

a bobbin case having an opening along the circumferential edge thereof;

a bobbin having a bobbin shaft on which a bobbin thread is wound, said bobbin being rotatably disposed in the bobbin case;

bobbin drive means for turning the bobbin in the bobbin case;

insertion means for inserting the tip of the bobbin thread supplied from a thread supply source into the bobbin case through the opening of the bobbin case;

bobbin drive control means for controlling the bobbin drive means wherein the bobbin thread inserted into the bobbin case is entwined round the bobbin shaft with the turn of the bobbin; and thread winding detecting means, connected to the bobbin drive control means, for detecting the start of winding of the bobbin thread twisted round the bobbin shaft by detecting an increase in the speed at which the bobbin thread is drawn from said thread supply, wherein the bobbin thread that is inserted into the bobbin case through the opening of the bobbin case is entwined round the bobbin shaft, with the turn of the bobbin driven by the bobbin drive means, and the twisting of the bobbin thread round the bobbin shaft is detected in response to the output signal of the thread winding detecting means.

2. A bobbin thread winding apparatus according to claim 1, further comprising:

a bobbin thread with a tip;

thread winding amount detecting means for detecting the amount of the bobbin thread that is wound around the bobbin shaft driven by the bobbin drive means;

detection control means for carrying out such a control as to start the detection of the thread winding amount in response to the detection of the start of winding the bobbin thread.

3. The bobbin thread winding apparatus according to claim 1, wherein the bobbin shaft has an outer surface and the outer surface has a thread winding side in which an air means blows the bobbin thread in a direction towards the bobbin wherein a tip of the air means is closer to the thread-winding side of the outer surface than to a line that is prolonged from the tip of the air means and passing through the center of the bobbin shaft.

4. The bobbin thread winding apparatus according to claim 1, wherein.

said insertion means includes a draw-out roller, located between said thread supply and said bobbin case, being rotatable while having said bobbin thread wound thereon; and said thread winding detection means comprises means for sensing a speed of rotation of said draw out roller.

5. The bobbin thread winding apparatus according to claim 4, wherein said rotation speed detecting means comprises:

a slotted disk coupled to said draw-out roller for rotation therewith;

an optical detector sensing rotation of said slotted disk and generating pulsed output signals corresponding to said rotation speed; and control circuitry accepting said pulsed output signals and determining therefrom said increase in said speed at which said bobbin thread is drawn from said thread supply.

6. The bobbin thread winding apparatus according to claim 5, wherein said optical detector determines said thread speed by detecting a reduction in a time increment between said pulsed output signals.

7. A bobbin thread winding apparatus comprising:

a bobbin case having an opening along the circumferential edge thereof;

a bobbin having a bobbin shaft on which a bobbin thread is wound, said bobbin being rotatably disposed in the bobbin case;

bobbin drive means for turning the bobbin in the bobbin case;

a draw-out roller, located between a thread supply source and the bobbin case, being rotatable while having the bobbin thread wound thereon;

draw-out roller drive means for turning the draw-out roller at a speed lower than a bobbin speed of the bobbin turned by the bobbin drive means;

a one-way clutch for connecting and disconnecting the draw-out roller to and from the draw-out roller drive means so as to allow the bobbin drive means to turn the draw-out roller;

roller turn detecting means for detecting the turn of the draw-out roller; and air guide means for guiding the bobbin thread that is drawn out by the turn of the draw-out roller caused by the draw-out roller drive means, into the opening of the bobbin case by an air stream;

whereby the bobbin thread that is guided to the opening of the bobbin case is fed into the bobbin case by the use of the turn of the draw-out roller caused by the draw-out roller drive means and an air stream caused by the air guide means, the bobbin thread is entwined round the bobbin shaft with the turn of the bobbin driven by the bobbin drive means, and the entwining of the bobbin thread round the bobbin shaft is detected in response to the output signal of the roller turn detecting means.

8. The bobbin thread winding apparatus according to claim 7, wherein said roller turn detecting means comprises:

a slotted disk coupled to said draw-out roller for rotation therewith;

an optical detector sensing rotation of said slotted disk and generating pulsed output signals corresponding to said rotation speed; and control circuitry accepting said pulsed output signals and determining therefrom said increase in said speed at which said bobbin thread is drawn from said thread supply, and wherein entwining of the bobbin thread detected by detecting a reduction in a time increment between said pulsed output signals.

9. A bobbin thread winding apparatus comprising:

a bobbin case having an opening along the circumferential edge thereof;

a bobbin having a bobbin shaft on which a bobbin thread may be wound, said bobbin being rotatably contained in the bobbin case;

bobbin drive means for turning the bobbin in the bobbin case;

thread insertion means for pulling a bobbin thread of such a length long enough to twine the thread round the bobbin shaft from a thread supply source, and inserting the pulled-out bobbin thread into the bobbin case through the opening of the bobbin case;

thread twining means for twining the bobbin thread that is inserted into the bobbin case by the thread insertion means round the bobbin shaft in cooperation with the turn of the bobbin caused by the bobbin drive means;

wherein the bobbin thread is wound around the bobbin contained in the bobbin case by turning the bobbin shaft round entwined with the bobbin thread by the bobbin drive means; and cutting means for cutting the bobbin thread that is wound around the bobbin shaft and led out of the bobbin case at a thread cutting point, the distance between said thread cutting point and the fore end of the thread insertion means being substantially equal to the length long enough to twine the bobbin thread around the bobbin shaft.

10. The bobbin thread winding apparatus according to claim 9, in which the thread insertion means is air guide means for guiding a bobbin thread supplied from a thread supply source to the opening of the bobbin case along a thread guide path, pulling out the bobbin thread of such a length long enough to twine the bobbin thread around the bobbin shaft, and inserting the pulled-out bobbin thread into the bobbin case through an opening of the bobbin case, with the aid of an air stream.

11. The bobbin thread winding apparatus according to claim 9, in which the thread twining means is an air means for causing an air stream in the bobbin case so that the bobbin thread introduced into the bobbin case by the thread insertion means is entwined round the bobbin shaft.

12. The bobbin thread winding apparatus according to claim 11, wherein the bobbin shaft has an outer surface and the outer surface has a thread winding side, in which the direction of the air blown from the air means is closer to the thread-winding side of the outer surface than to a line that is prolonged from a tip of the air means, while passing through the center of the bobbin shaft.

13. The bobbin thread winding apparatus according to claim, further comprising:

moving means for moving a fore end of the thread insertion means between a work position in the vicinity of the opening of the bobbin case and a retract position located apart from the work position, a distance between the work position and the retract position being substantially equal to the length long enough to twine the thread around the bobbin shaft from a thread supply source, wherein the fore end of the thread insertion means is moved apart from the work position by the moving means, and the bobbin thread is wound around the bobbin shaft.

14. The bobbin thread winding apparatus according to claim 9, further comprising:

thread hooking means for hooking to the bobbin case the bobbin thread that is wound around the bobbin shaft and led from the opening of the bobbin case, and allowing the bobbin thread to be led out under tension from a thread tension spring;

moving means for moving a fore end of the thread insertion means between a work position in the vicinity of the opening of the bobbin case and a retract position located apart from the work position, a distance between the work position and the retract position being substantially equal to the length long enough to twine the thread around the bobbin shaft from a thread supply source, wherein the fore end of the thread insertion means is moved apart from the work position by the moving means, and the bobbin thread is hooked to the bobbin case.

15. The bobbin thread winding apparatus according to claim 9, further comprising:

moving means for moving a fore end of the thread insertion means between a work position in the vicinity of the opening of the bobbin case and a retract position located apart from the work position, a distance between the work position and the retract position being substantially equal to the length long enough to twine the thread around the bobbin shaft from a thread supply source, wherein the fore end of the thread insertion means is moved apart from the work position by the moving means, and the bobbin thread is cut.

16. The bobbin thread winding apparatus according to any of claims 9, 13, or 14, in which the fore end of the thread insertion means may be set at either one of a work position and a retract position.

17. The bobbin thread winding apparatus according to claim 9, further comprising thread twining detecting means for detecting the twining of the thread around the bobbin shaft, wherein the twining of the thread around the bobbin shaft is detected according to an output signal of the thread-twining detecting means.

* * * * *

UNITED STATES PATENT AND TRADEMARK OFFICE

CERTIFICATE OF CORRECTION

PATENT NO. : 5,839,679

DATED : November 24, 1998

INVENTOR(S) : Kazunori KATAYAMA et al.

It is certified that error appears in the above-identified patent and that said Letters Patent is hereby corrected as shown below:

Column 41, line 16, change "claim," to --claim 9,--.

Signed and Sealed this

Eleventh Day of May, 1999

*Attest:*

*Attesting Officer*

Q. TODD DICKINSON

*Acting Commissioner of Patents and Trademarks*